US008047014B2

(12) United States Patent
Yabu et al.

(10) Patent No.: US 8,047,014 B2
(45) Date of Patent: Nov. 1, 2011

(54) HUMIDITY CONTROL SYSTEM

(75) Inventors: Tomohiro Yabu, Osaka (JP); Shuji Ikegami, Osaka (JP); Yoshinori Narikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 461 days.

(21) Appl. No.: 10/594,916

(22) PCT Filed: Mar. 30, 2005

(86) PCT No.: PCT/JP2005/006102
§ 371 (c)(1),
(2), (4) Date: Sep. 29, 2006

(87) PCT Pub. No.: WO2005/095874
PCT Pub. Date: Oct. 13, 2005

(65) Prior Publication Data

US 2007/0209385 A1 Sep. 13, 2007

(30) Foreign Application Priority Data

Mar. 31, 2004 (JP) ..... 2004-101703
Mar. 31, 2004 (JP) ..... 2004-102384
Mar. 31, 2004 (JP) ..... 2004-102403

(51) Int. Cl.
*F25B 13/00* (2006.01)

(52) U.S. Cl. ..... 62/324.5; 62/86; 62/324.1; 62/272; 62/160; 62/179; 62/180; 62/181; 62/183; 236/44 A; 236/44 C; 236/49.3

(58) Field of Classification Search ..... 62/324.1, 62/272, 160, 179, 180, 181, 183, 324.5, 186; 236/44 A, 44 C, 49.3
See application file for complete search history.

(56) References Cited

U.S. PATENT DOCUMENTS 2,526,874 A * 10/1950 Jones ..... 62/159
3,805,542 A * 4/1974 Hosoda et al. ..... 62/262
4,424,686 A * 1/1984 Lapeyre et al. ..... 62/259.1
4,793,143 A 12/1988 Rhodes
5,042,271 A * 8/1991 Manz ..... 62/473
5,911,751 A * 6/1999 Kim ..... 62/407
6,644,059 B2 * 11/2003 Maeda et al. ..... 62/271
7,096,684 B2 8/2006 Yabu et al.

FOREIGN PATENT DOCUMENTS

EP 1621822 A1 2/2006

(Continued)

*Primary Examiner* — Cheryl J Tyler
*Assistant Examiner* — Melanie Reuter
(74) *Attorney, Agent, or Firm* — Birch, Stewart, Kolasch & Birch, LLP

(57) ABSTRACT

A humidity control system (10) is disclosed which includes a refrigerant circuit (60). The refrigerant circuit (60) includes first and second absorbent-supported heat exchangers (61, 62) and performs a refrigeration cycle by the circulation of refrigerant. In addition, in the refrigerant circuit (60), the circulation direction of refrigerant is reversible. The first and second heat exchangers (61, 62) are disposed in a casing (11). In the humidity control system (10), the distribution route of air is changed such that a first air stream is passed through either one of the first and second heat exchangers (61, 61) that is functioning as an evaporator while a second air stream is passed through the other heat exchanger that is functioning as a condenser. A compressor (63), an expansion mechanism (65), and a four-way valve (64) in the refrigerant circuit (60) are disposed together with the heat exchangers (61, 62) in the casing (11).

18 Claims, 20 Drawing Sheets

FOREIGN PATENT DOCUMENTS

| | | | | |
|---|---|---|---|---|
| EP | 1624256 | A1 | | 2/2006 |
| EP | 1630482 | A1 | | 3/2006 |
| EP | 1804005 | A1 | | 7/2007 |
| JP | 61-197933 | A | | 9/1986 |
| JP | 6-323566 | A | | 11/1994 |
| JP | 7-265649 | A | | 10/1995 |
| JP | 07-275642 | A | | 10/1995 |
| JP | 8-189667 | A | | 7/1996 |
| JP | 9-329371 | A | | 12/1997 |
| JP | 10-311581 | A | | 11/1998 |
| JP | 2002-364879 | A | | 12/2002 |
| JP | 2003-202128 | A | | 7/2003 |
| JP | 2003-314856 | A | | 11/2003 |
| JP | 2003314856 | A | * | 11/2003 |
| JP | 2004-60966 | A | | 2/2004 |
| WO | WO-2004/013541 | A1 | | 2/2004 |

* cited by examiner (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y (A) VIEW TAKEN IN DIRECTION OF ARROWS X-X (B) TOP PLAN VIEW (C) VIEW TAKEN IN DIRECTION OF ARROWS Y-Y

HUMIDITY CONTROL SYSTEM

TECHNICAL FIELD

The present invention generally relates to humidity control systems for controlling the level of humidity in the air and more specifically this invention relates to a humidity control system adapted to accomplish regeneration and cooling of the adsorbent by performing a refrigeration cycle.

BACKGROUND ART

As disclosed in, for example, Patent Document I (see below), humidity control systems, for regulating the level of humidity in the air by the use of an adsorbent and by performing a refrigeration cycle, are well known in the conventional technology. Such a humidity control system is provided with two adsorption units. Each adsorption unit is made up of an adsorbent-filled mesh container and a refrigerant line which is passed completely through the mesh container. The refrigerant line of each adsorption unit is fluidly connected to a refrigerant circuit which performs a refrigeration cycle. In addition, the humidity control system is provided with dampers for effecting switching of the air which is delivered to each adsorption unit.

During the operation of the above-described humidity control system, the compressor of the refrigerant circuit operates and a refrigeration cycle is performed in which one of the two adsorption units becomes an evaporator while the other adsorption unit becomes a condenser. In addition, the direction in which the refrigerant is circulated in the refrigerant circuit is changed by controlling a four-way valve, whereby each adsorption unit alternately functions as an evaporator and as a condenser.

When the humidity control system is in a humidification mode of operation, supply air flowing from the outside to the inside of the room is directed to one adsorption unit which becomes a condenser. The supply air is humidified with moisture desorbed from the adsorbent. At that time, exhaust air flowing from the inside to the outside of the room is directed to the other adsorption unit which becomes an evaporator and the adsorbent recovers moisture present in the exhaust air. On the other hand, when the humidity control system is in a dehumidification mode of operation, supply air flowing from the outside to the inside of the room is directed to one adsorption unit which becomes an evaporator and the adsorbent adsorbs moisture present in the supply air. At that time, exhaust air flowing from the inside to the outside of the room is directed to the other adsorption unit which becomes a condenser. Moisture desorbed from the adsorbent is discharged together with the exhaust air to outside the room.

In addition, as a means capable of functioning in the same way as the aforesaid adsorption units, a heat exchange member, as disclosed in, for example, Patent Document II (see below), has been known in the conventional technology. In this heat exchange member, plate-shaped fins are arranged around a copper pipe and adsorbent is supported on the surface of the copper pipe and on the surface of each fin. And the heat exchange member is configured such that the adsorbent is heated and cooled with fluid flowing through the copper pipe.

Additionally, as a humidity control system of the above-described type, there is proposed a humidity control system as shown in Patent Document III (see below). In this humidity control system, an air passageway for providing fluid communication between an outdoor space and an indoor space is formed in the casing and an adsorption element is disposed in the air passageway. Outdoor air (OA) is distributed through the adsorption element so that it adsorbs thereon moisture present in the outdoor air (OA). Then, the outdoor air (OA) is supplied, as dehumidified air (humidity controlled air (SA)), to the indoor space. In addition, it is arranged such that, for example, moisture adsorbed on the adsorption element is desorbed; the desorbed moisture is fed to outdoor air (OA); and the outdoor air (OA) is supplied, as humidified air (humidity controlled air (SA)) to the indoor space.

Patent Document I: JP H8-189667A
Patent Document II: JP H7-265649A
Patent Document III: JP H9-329371A

DISCLOSURE OF THE INVENTION

Problems that the Invention Intends to Solve

Incidentally, in the above-described conventional humidity control system, it is desired that the temperature at which the refrigerant will condense in the heat exchanger be raised as high as possible in order to raise the regeneration temperature of the adsorbent. The reason for this is that if the adsorbent regenerating temperature is raised the amount of moisture which is desorbed from the adsorbent is increased and the efficiency of the humidity control system is improved.

In addition, if a part of the refrigerant circuit is arranged outside the casing, this requires that the refrigerant circuit be connected by piping at the time of installation of the humidity control system. This produces a problem in that the installation work will become troublesome.

With the above problem in mind, the present invention was made. Accordingly, an object of the present invention is to increase the regeneration amount of an adsorbent to enhance its efficiency, and to facilitate the work of installation.

Means for Solving the Problems

In order to accomplish the above object, in the present invention, a compressor (63), an expansion mechanism (65), and a reversal mechanism (64) for reversing the circulation direction of refrigerant in a refrigerant circuit (60) are disposed together with heat exchangers (61, 62) in a casing (11).

More specifically, the present invention provides, as a first aspect, a humidity control system for supplying either one of a dehumidified first air stream and a humidified second air stream to an indoor space and for discharging the other air stream to an outdoor space. In the first aspect, (i) the humidity control system comprises: a refrigerant circuit (60) which includes first and second adsorbent-supported heat exchangers (61, 62) which are fluidly connected in the refrigerant circuit (60) to perform a refrigeration cycle, and which is capable of reversing the circulation direction of refrigerant; a casing (11) internally having an air passageway in which the heat exchangers (61, 62) are disposed; and a switching mechanism for changing the distribution route of air in the casing (11) depending on the circulation direction of refrigerant in the refrigerant circuit (60) so that the first air stream is passed through one of the heat exchangers (61, 62) that is functioning as an evaporator while the second air stream is passed through the other heat exchanger that is functioning as a condenser and (ii) a compressor (63), an expansion mechanism (65), and a reversal mechanism (64) for reversing the circulation direction of refrigerant in the refrigerant circuit (60) are disposed together with the heat exchangers (61, 62) in the casing (11).

According to the above arrangement, two different refrigeration cycles are alternately repeatedly carried out in the refrigerant circuit (60) by the action of switching effected by the reversal mechanism (64). During the first refrigeration cycle operation, a second air stream is delivered to the first heat exchanger (61) which becomes a condenser while a first air stream is delivered to the second heat exchanger (62) which becomes an evaporator. In the first heat exchanger (61), the adsorbent thereof is heated by the refrigerant to become regenerated and moisture desorbed from the adsorbent is fed to the second air stream. Meanwhile, in the second heat exchanger (62), the adsorbent thereof adsorbs moisture present in the first air stream and the resulting heat of adsorption is absorbed by the refrigerant. On the other hand, during the second refrigeration cycle operation, the switching mechanism switches the distribution route of air to a route different from that in the first refrigeration cycle operation so that a first air stream is delivered to the first heat exchanger (61) which becomes an evaporator while a second air stream is delivered to the second heat exchanger (62) which becomes an condenser. In the first heat exchanger (61), the adsorbent thereof adsorbs thereon moisture present in the first air stream and the resulting heat of adsorption is absorbed by the refrigerant. Meanwhile, in the second heat exchanger (62), the adsorbent thereof is heated by the refrigerant to become regenerated and moisture desorbed from the adsorbent is fed to the second air stream.

In this aspect of the present invention, the humidity control system (10) supplies either a dehumidified first air stream or a humidified second air stream to the indoor space. Stated another way, the humidity control system (10) may be either one that supplies only a dehumidified first air stream to the indoor space or another that supplies only a humidified second air stream to the indoor space. In addition, the humidity control system (10) may be one that is operable to switch its operation between an operation of supplying a dehumidified first air stream to the indoor space and an operation of supplying a humidified second air stream into the indoor space.

Furthermore, in this aspect of the present invention, the compressor (63), the expansion mechanism (65), and the reversal mechanism (64) for reversing the circulation direction of refrigerant in the refrigerant circuit (60) are disposed together with the heat exchangers (61, 62) in the casing (11). This arrangement eliminates the need for establishing, by piping, fluid connections among components of the refrigerant circuit (60) at the time of installation of a humidity control system, thereby making it possible to make its shipment with refrigerant filled therein. This therefore extremely facilitates its installation work.

In addition, the refrigerant circuit (60) is accommodated inside the casing (11). Because of this arrangement, the connection piping of the refrigerant circuit (60) can be made shorter, whereby the in-piping pressure loss is reduced and, as a result, the condensing temperature of refrigerant is raised. Accordingly, the refrigerant temperature during regeneration becomes higher and the adsorbent regeneration amount is increased to thereby make it possible to improve the efficiency of the humidity control system.

The present invention provides, as a second aspect in accordance with the first aspect, a humidity control system in which the compressor (63) is disposed in a space partitioned from the internal air passageway of the casing (11).

According to the above arrangement, since the compressor (63) is disposed outside the air passageway, this prevents air which is supplied to the indoor space from being affected adversely by thermal radiation from the compressor (63) itself.

The present invention provides, as a third aspect in accordance with the first aspect, a humidity control system in which the compressor (63) is disposed in the internal air passageway of the casing (11).

According to the above arrangement, since the compressor (63) is disposed in the air passageway, this makes it possible to make efficient use of thermal radiation from the compressor (63) itself. For example, if the compressor (63) is disposed along the distribution route of air which is supplied to the indoor space, this gives rise to a raise in air temperature, thereby improving the room heating effect. This is therefore advantageous for humidity control systems designed to give priority to the heating effect. On the other hand, if the compressor (63) is disposed along the distribution route of air which is discharged to the outdoor space, this makes it possible to release surplus heat to the outdoor space by discarding the air which has absorbed thermal radiation from the compressor (63) itself to the outdoor space. This is therefore advantageous for humidity control systems designed to give priority to the room cooling effect and, in addition, it is possible to discard heat from the compressor (63) to the outdoor space, thereby enhancing the efficiency of the humidity control system.

The present invention provides, as a fourth aspect in accordance with any one of the first to third aspects, a humidity control system in which, in the casing (11), an outlet opening (24) and an inlet opening (22) are opened to provide fluid connection with ducts (72, 74) in fluid communication with the indoor space and an outlet opening (23) and an inlet opening (21) are opened to provide fluid connection with ducts (71, 73) in fluid communication with the outdoor space.

According to the above arrangement, the humidity control system can be installed in a most suitable place by making utilization of the ducts (71, 72, 73, 74) for establishing fluid communication between the indoor and outdoor spaces and the casing (11).

The present invention provides, as a fifth aspect in accordance with any one of the first to third aspects, a humidity control system in which, in the casing (11), an outlet opening (24) and an inlet opening (22) are opened to provide direct fluid communication between the casing (11) and the indoor space and an outlet opening (23) and an inlet opening (21) are opened to provide fluid connection with ducts (71, 73) in fluid communication with the outdoor space.

According to the above arrangement, it is possible to make efficient use of, for example, a space under the roof because there is no need to provide the ducts (72, 74) in fluid communication with the indoor space.

The present invention provides, as a sixth aspect in accordance with the first aspect, a humidity control system in which the humidity control system includes an air supplying fan (25) and an air exhausting fan (26) which are disposed in the casing (11); the casing (11) is shaped like a box; the casing (11) has an internal space which is divided into a first space (17) defined along a fan side lateral plate (13) as a lateral plate of the casing (11), and a remaining second space (18); and the air supplying fan (25) and the air exhausting fan (26) are disposed in the first space (17) and the first and second heat exchangers (61, 62) and the switching mechanism are disposed in the second space (18).

In this aspect of the present invention, the internal space of the casing (11) is divided into two spaces, wherein the air supplying fan (25) and the air exhausting fan (26) are disposed in one of the two spaces that is defined along the fan side lateral plate (13), i.e., the first space (17), while the first and second heat exchangers (61, 62) and the switching mechanism are disposed in the other space, i.e., the second space (18). This therefore makes the system overall size dramatically compact, even when compared to the case where the fans (25, 26) are laid out on a diagonal line of the casing (11), and it becomes possible to provide a humidity control system suitable for installation even in a small area like an under-roof space.

The present invention provides, as a seventh aspect in accordance with the sixth aspect, a humidity control system in which the compressor (63) of the refrigerant circuit (60) is disposed between the air supplying fan (25) and the air exhausting fan (26) in the first space (17) of the casing (11).

Here, the two heat exchangers (61, 62) are disposed within the casing (11). Each of these heat exchangers (61, 62) requires a predetermined size in order to secure its humidity control capacity, and there is created a certain space between the air supplying fan (25) and the air exhausting fan (26). On the other hand, according to the seventh aspect of the present invention, such a space can be effectively used to accommodate therein the compressor (63), thereby making it possible to downsize the humidity control system to a further extent.

The present invention provides, as an eighth aspect in accordance with the sixth aspect, a humidity control system in which the first and second heat exchangers (61, 62) are so arranged as to allow passage of air in the thickness direction of the casing (11).

According to the above arrangement, a low-profile humidity control system is provided in the case where, when a humidity control system is horizontally mounted (for example, when it is flush-mounted into the ceiling), the two heat exchangers (61, 62) are also substantially horizontally arranged.

The present invention provides, as a ninth aspect in accordance with the sixth aspect, a humidity control system in which the first and second heat exchangers (61, 62) are so arranged as to allow passage of air in a direction perpendicular to the thickness direction of the casing (11).

According to the above arrangement, a small-width humidity control system is provided in the case where, when a humidity control system is horizontally mounted (for example, when it is flush-mounted into the ceiling), the two heat exchangers (61, 62) are also substantially horizontally arranged.

The present invention provides, as a tenth aspect in accordance with the sixth aspect, a humidity control system in which the air supplying fan (25) and the air exhausting fan (26) are each formed by a respective multi-blade fan which is configured to draw in air from a lateral side of a fan casing thereof and then deliver it forward and which is disposed such that the center of axle of its impeller is oriented in the thickness direction of the casing (11).

According to the above arrangement, it becomes possible to reduce the thickness of the humidity control system for the case of a low-profile fan in which the overall fan size in the direction of the center of axle of its impeller is small relative to the impeller diameter.

The present invention provides, as an eleventh aspect in accordance with the tenth aspect, a humidity control system in which: an air supplying opening (24) and an inside air inlet opening (22) which are in fluid communication with the indoor space are provided in one of lateral plates (14, 15) of the casing (11) which are orthogonal to the fan side lateral plate (13), and an air exhausting opening (23) and an outside air inlet opening (21) which are in fluid communication with the outdoor space are provided in the other of the lateral plates (14, 15); in the second space (18), (i) a first heat exchange chamber (41) in which the first heat exchanger (61) is accommodated and a second heat exchange chamber (42) in which the second heat exchanger (62) is accommodated are defined adjacently side by side in a direction orthogonal to the fan side lateral plate (13) and (ii) a first inflow path (43) for the inflow of air and a first outflow path (44) for the outflow of air are provided which extend along one of continuous lateral surfaces of the two heat exchange chambers (41, 42) and which are superimposedly arranged in the thickness direction of the casing (11) and a second inflow path (45) for the inflow of air and a second outflow path (46) for the outflow of air are provided which extend along the other of the continuous lateral surfaces of the two heat exchange chambers (41, 42) and which are superimposedly arranged in the thickness direction of the casing (11); and the outflow paths (44, 46) are in fluid communication with the first space (17) through fan side communication openings (75, 76).

According to the above arrangement, air drawn into the casing (11) flows into either of the first or the second inflow paths (43, 45), passes through either of the first or the second heat exchangers (61, 62), and is subjected to either of dehumidification or humidification. Subsequently, air in the first outflow path (44) passes through the fan side communication opening (76) and is discharged by either one of the air supplying fan (25) and the air exhausting fan (26), while air in the second outflow path (46) passes through the fan side communication opening (75) and is discharged by the other fan.

And, it is possible to fluidly connect the ducts (72, 74) in fluid communication with the indoor space with the air supplying opening (24) and the inside air inlet opening (22) which are formed in one lateral plate of the casing (11) and, in addition, it is possible to fluidly connect the ducts (71, 73) in fluid communication with the outdoor space with the air exhausting opening (23) and the outside air inlet opening (21) which are formed in another lateral plate of the casing (11). Consequently, each of the ducts (71, 72, . . . ) can be arranged straight towards the indoor space or towards the outdoor space. This facilitates arrangement of the piping of the ducts (71, 72, . . . ) and, in addition, achieves installation space savings.

The present invention provides, as a twelfth aspect in accordance with the tenth aspect, a humidity control system in which: an air supplying opening (24) in fluid communication with the indoor space and an air exhausting opening (23) in fluid communication with the outdoor space are provided in the fan side lateral plate (13) of the casing (11) and an inside air inlet opening (22) and an outside air inlet opening (21) are provided in a lateral plate (12) opposite the fan side lateral plate (13); in the second space (18), (i) a first heat exchange chamber (41) in which the first heat exchanger (61) is accommodated and a second heat exchange chamber (42) in which the second heat exchanger (62) is accommodated are defined adjacently side by side in the longitudinal direction of the fan side lateral plate (13) and (ii) between one of continuous lateral surfaces of the two heat exchange chambers (41, 42) and the lateral plate (12) opposite the fan side lateral plate (13) a first inflow path (43) for the inflow of air and a second inflow path (45) for the inflow of air are provided which extend along the lateral plate (12) and which are superimposedly arranged in the thickness direction of the casing (11) and between the other of the continuous lateral surfaces of the two heat exchange chambers (41, 42) and the fan side lateral plate (13) a first outflow path (44) for the outflow of air and a second outflow path (46) for the outflow of air are provided which extend along the fan side lateral plate (13) and which are superimposedly arranged in the thickness direction of the casing (11); and the outflow paths (44, 46) are in fluid communication with the first space (17) through fan side communication openings (75, 76).

According to the above arrangement, air drawn into the casing (11) from the inside and outside air inlet openings (22, 23) flows into either of the first or the second inflow paths (44, 46), passes through either of the first or the second heat exchangers (61, 62), and is subjected to either of dehumidification or humidification. Subsequently, air in the first outflow path (44) passes through the fan side communication opening (76) and is discharged by either one of the air supplying fan (25) and the air exhausting fan (26), while air in the second outflow path (46) passes through the fan side communication opening (75) and is discharged by the other fan.

In the above arrangement, the first and second inflow paths (43, 45) are arranged along one continuous lateral surface of the first and second heat exchange chambers (41, 42) which are disposed side by side in the longitudinal direction of the fan side lateral plate (13), while the first and second outflow paths (44, 46) are arranged along the other continuous lateral surface of the first and second heat exchange chambers (41, 42). Consequently, the humidity control system (the casing (11)) has a shape which is elongated in the direction orthogonal to the fan side lateral plate (13). This allows the ducts (71, 72, . . . ) to be arranged in the longitudinal direction of the humidity control system, i.e., in the direction orthogonal to the fan side lateral plate (13), thereby making it possible to reduce the space for the installation of the humidity control system in the longitudinal direction of the fan side lateral plate (13).

The present invention provides, as a thirteenth aspect in accordance with either of the eleventh or the twelfth aspects, a humidity control system in which: the air supplying fan (25) is arranged such that a fan inlet opening (27), provided in the lateral side of the fan casing of the air supplying fan (25), faces either one of the fan side communication openings (75, 76); and the air exhausting fan (26) is arranged such that a fan inlet opening (28), provided in the lateral side of the fan casing of the air exhausting fan (26), faces the other of the fan side communication openings (75, 76).

According to the above arrangement, the inlet openings (27, 28) on the side of the fan casing face towards the fan side communication openings (75, 76). Consequently, air dehumidified or humidified by the heat exchanger (61, 62) in either the first or the second outflow paths (44, 46) is smoothly drawn from the fan side communication opening (75, 76) by the fan (25, 26). Accordingly, the efficiency of the humidity control system is improved because of lowered air resistance.

The present invention provides, as a fourteenth aspect in accordance with sixth aspect, a humidity control system in which the expansion mechanism (65) and the reversal mechanism (64) for reversing the circulation direction of refrigerant in the refrigerant circuit (60) are disposed in the first space (17) of the casing (11).

According to the above arrangement, in addition to the compressor (63), the expansion mechanism (65) and the reversal mechanism (64) for reversing the circulation direction of refrigerant in the refrigerant circuit (60) are gathered in the first space (17), thereby making it possible to accomplish space saving of the entire system.

The present invention provides, as a fifteenth aspect in accordance with the fourteenth aspect, a humidity control system in which a piping arrangement of the refrigerant circuit (60) for fluid connection with the first and second heat exchangers (61, 62) is provided along a top plate of the casing (11).

According to the above arrangement, the piping of the refrigerant circuit (60) is arranged along the top plate of the casing (11). As a result of such piping arrangement, the refrigerant circuit (60) can be mounted from above and the maintenance of the refrigerant circuit (60) can be done also from above.

The present invention provides, as a sixteenth aspect in accordance with the first aspect, a humidity control system in which the humidity control system includes an outdoor filter (124) which is arranged and formed along both an outside-air inflow surface of the first heat exchanger (61) and an outside-air inflow surface of the second heat exchanger (62).

In the sixteenth aspect of the present invention, outside air (OA) after passage through the outdoor filter (124) is distributed in the distribution space of the heat exchanger (61, 62) from the inflow surface of the heat exchanger (61, 62). At that time, dust particles in the outside air (OA) are trapped by the outdoor filter (124). And, for example, moisture present in the outside air (OA) is adsorbed by the heat exchanger (61, 62), whereby the outside air (OA) is dehumidified. In addition, for example, moisture adsorbed by the heat exchanger (61, 62) is desorbed and then supplied to outside air (OA) to humidify it.

Incidentally, the inflow surface of the heat exchanger (61, 62) is typically designed such that it has a relatively large area in order to reduce the vent resistance of air to be treated and distributed in the heat exchanger (61, 62) and in order to enhance the efficiency of contact between the air to be treated and the heat exchanger (61, 62). On the other hand, in the sixteenth aspect of the present invention, the outdoor filter (124) is arranged and formed along the inflow surface of the heat exchanger (61, 62). This makes it possible to broaden the inflow area of outside air (OA) in the outdoor filter (124), thereby inhibiting the rise in pressure loss due to the installation of the outdoor filter (124). In addition, the outdoor filter (124) has a larger dust trapping surface, whereby dust particles present in the outside air (OA) are trapped scatteringly throughout the outdoor filter (124). This therefore prevents dust particles from being trapped locally in the outdoor filter (124). That is, the rise in vent pressure loss due to the outdoor filter (124) being clogged with dust is inhibited.

The present invention provides, as a seventeenth aspect in accordance with the sixteenth aspect, a humidity control system in which: a first passageway (41) in which the first heat exchanger (61) is disposed and a second passageway (42) in which the second heat exchanger (62) is disposed are formed in the casing (11); and the outdoor filter (124) comprises a first filter part (124*a*) disposed in the first passageway (41) and a second filter part (124*b*) disposed in the second passageway (42).

In the seventeenth aspect of the present invention, the first filter part (124*a*) is arranged and formed along the inflow surface of outside air (OA) in the first heat exchanger (61). This therefore makes it possible to inhibit the rise in vent pressure loss due to the installation of the first filter part (124*a*). In addition, in this aspect of the present invention, the second filter part (124*b*) is arranged and formed along the inflow surface of outside air (OA) in the second heat exchanger (62). This therefore makes it possible to inhibit the rise in vent pressure loss due to the installation of the second filter part (124*b*).

The present invention provides, as an eighteenth aspect in accordance with the seventeenth aspect, a humidity control system in which: in the outdoor filter (124), the first filter part (124*a*) and the second filter part (124*b*) are integral with each other; and the outdoor filter (124) is arranged such that it extends over both the outside-air inflow surface of the first heat exchanger (61) and the outside-air inflow surface of the second heat exchanger (62).

According to the above arrangement, the first filter part (124*a*) and the second filter part (124*b*) are formed integrally with each other and they are arranged and formed, respectively, along the inflow surface of the first heat exchanger (61) and along the inflow surface of the second heat exchanger (62).

The present invention provides, as a nineteenth aspect in accordance with the eighteenth aspect, a humidity control system in which, in the casing (11), the first heat exchanger (61) and the second heat exchanger (62) are disposed adjacently to each other and the inflow surface of the first heat exchanger (61) and the inflow surface of the second heat exchanger (62) lie on approximately the same plane.

In the nineteenth aspect of the present invention, the first filter part (124*a*) and the second filter part (124*b*) can be disposed adjacently to each other and, in addition, can be arranged and formed in the same plane along the inflow surface of the first heat exchanger (61) and along the inflow surface of the second heat exchanger (62), respectively. Accordingly, the outdoor filter (124) can be downsized by forming it into a single flat plate-like shape or into a sheet-like shape.

The present invention provides, as a twentieth aspect in accordance with the sixteenth aspect, a humidity control system in which the casing (11) is provided with a take-out opening (161) from which the outdoor filter (124) can be taken out.

In the twentieth aspect of the present invention, the outdoor filter (124) can be taken out of the casing (11) through the take-out opening (161) of the casing (11) for the purpose of maintenance.

The present invention provides, as a twenty-first aspect in accordance with the seventeenth aspect, a humidity control system in which the humidity control system is operable to switch its operation between a first operation in which outside air is distributed first through the first filter part (124*a*) and then through the first heat exchanger (61) and is thereafter supplied to the indoor space while simultaneously room air is distributed first through the second heat exchanger (62) and then through the second filter part (124*b*) and is thereafter discharged to the outside space, and a second operation in which outside air is distributed first through the second filter part (124*b*) and then through the second heat exchanger (62) and is thereafter supplied to the indoor space while simultaneously room air is distributed first through the first heat exchanger (61) and then through the first filter part (124*a*) and is thereafter discharged to the outdoor space.

In the twenty-first aspect of the present invention, outside air (OA) in the first operation is passed first through the first filter part (124*a*) and then through the first heat exchanger (61), so that the first filter part (124*a*) traps dust particles present in the outside air (OA) distributed during the first operation. On the other hand, room air (RA) in the second operation is passed in the direction opposite to the direction in which the outside air (OA) is made to flow in the first operation, in other words the room air (RA) is passed first through the first heat exchanger (61) and then through the first filter part (124*a*). Consequently, the dust particles trapped by the first filter part (124*a*) are blown away by the room air (RA) and discharged to the outdoor space, in other words the dust particles in the first filter part (124*a*) are removed.

In addition, in this aspect of the present invention, outside air (OA) in the second operation is passed first through the second filter part (124*b*) and then through the second heat exchanger (62), so that the second filter part (124*b*) traps dust particles present in the outside air (OA) distributed during the second operation. On the other hand, room air (RA) in the first operation is passed in the direction opposite to the direction in which the outside air (OA) is made to flow in the second operation, in other words the room air (RA) is passed first through the second heat exchanger (62) and then through the second filter part (124*b*). Consequently, the dust particles trapped by the second filter part (124*b*) are blown away by the room air (RA) and discharged to the outdoor space, in other words the dust particles in the second filter part (124*b*) are removed.

The present invention provides, as a twenty-second aspect in accordance with the seventeenth aspect, a humidity control system in which the humidity control system includes an indoor filter (123*b*) which is disposed in a passageway through which room air is made to flow into either of the first or the second passageways (41, 42), and the humidity control system is operable to switch its operation between a first operation in which outside air is distributed first through the first filter part (124*a*) and then through the first heat exchanger (61) and is thereafter supplied to the indoor space while simultaneously room air is distributed first through the indoor filter (123*b*), then through the second heat exchanger (62), and then through the second filter part (124*b*) and is thereafter discharged to the outside space, and a second operation in which outside air is distributed first through the second filter part (124*b*) and then through the second heat exchanger (62) and is thereafter supplied to the indoor space while simultaneously room air is distributed first through the indoor filter (123*b*), then through the first heat exchanger (61), and then through the first filter part (124*a*) and is thereafter discharged to the outdoor space.

In the twenty-second aspect of the present invention, the adhesion of dust present in the room air (RA) in the first and second heat exchangers (61, 62) is prevented by the indoor filter (123*b*). Besides, by repetition of the first and second operations, dust particles carried by outside air (OA) and adhering to the outdoor filter (124) are blown away by room air (RA) and removed therefrom.

The present invention provides, as a twenty-third aspect in accordance with either of the first or the sixteenth aspects, a humidity control system in which: a first passageway (41) in which the first heat exchanger (61) is disposed, a second passageway (42) in which the second heat exchanger (62) is disposed, and a room-air supplying passageway through which room air is made to flow into either of the first or the second passageways (41, 42) are formed in the casing (11); and the humidity control system includes an indoor filter (123*b*) which is disposed in the room-air supplying passageway.

In the twenty-third aspect of the present invention, the casing (11) is provided with a room-air supplying passageway for fluid communication between the indoor space and the first or the second passageways (41, 42), and the room-air supplying passageway is provided with the indoor filter (123*b*). This therefore prevents dust particles, carried by room air (RA) flowing into the second heat exchanger (62) in the first operation, from adhering to the second heat exchanger (62). On the other hand, dust particles, carried by room air (RA) flowing into the first heat exchanger (61) in the second operation, are prevented from adhering to the first heat exchanger (61).

The present invention provides, as a twenty-fourth aspect in accordance with either of the first or the sixteenth aspects, a humidity control system in which: a first passageway (41) in which the first heat exchanger (61) is disposed and a second passageway (42) in which the second heat exchanger (62) is disposed are formed in the casing (11); and the humidity control system includes: a suction opening (163) which faces the indoor space by being in fluid connection with an air passageway which is located nearer to the indoor space than the first and second passageways (41, 42) in the casing (11), and an indoor filter (123*b*) which is disposed in the vicinity of an opening part of the suction opening (163).

In the twenty-fourth aspect of the present invention, the casing (11) is provided with a room-air supplying passageway for fluid communication between the indoor space and the first or second passageways (41, 42), and the room-air supplying passageway is provided with the indoor filter (123*b*). This therefore prevents dust particles, carried by room air (RA) flowing into the second heat exchanger (62) in the first operation, from adhering to the second heat exchanger (62). On the other hand, dust particles, carried by room air (RA) flowing into the first heat exchanger (61) in the second operation, are prevented from adhering to the first heat exchanger (61).

In addition, in this aspect of the present invention, the indoor filter (123*b*) is disposed in the vicinity of the opening part of the suction opening (163) which is so disposed as to face towards the indoor space. This therefore makes it possible to facilitate replacement and maintenance of the indoor filter (123*b*) from the side of the indoor space.

Effects of the Invention

As described above, according to the present invention, the compressor (63), the expansion mechanism (65), and the reversal mechanism (64) for reversing the circulation direction of refrigerant in the refrigerant circuit (60) are disposed together with the heat exchangers (61, 62) in the casing (11). This arrangement therefore makes it possible to ship and install a humidity control system with refrigerant filled therein, thereby facilitating work of installing the humidity control system, and the pressure loss is reduced to thereby raise the condensing temperature, thereby making it possible to improve the efficiency of the humidity control system.

In addition, according to the sixth aspect of the present invention, the air supplying fan (25) and the air exhausting fan (26) are disposed in the first space (17) defined along the fan side lateral plate (13) in the casing (11) and the first and second heat exchangers (61, 62) and the switching mechanism are disposed in the second space (18), thereby achieving space saving of the entire system and providing a humidity control system capable of easy installation in a small area such as an under-roof space.

According to the sixteenth aspect of the present invention, the outdoor filter (124) is arranged and formed along the outside air (OA) inflow surfaces of the heat exchangers (61, 62). Consequently, the inflow area of outside air (OA) in the outdoor filter (124) can be enlarged, thereby making it possible to inhibit the rise in pressure loss due to the installation of the outdoor filter (124). Furthermore, dust particles present in outside air (OA) are trapped scatteringly in the outdoor filter (124), thereby making it possible to inhibit the rise in pressure loss when the outdoor filter (124) is being clogged with dust. Accordingly, while preventing the occurrence of dust adhesion to the heat exchangers (61, 62), the reduction in vent pressure loss is achieved, and for example the power load of the suction fan can be reduced.

In the seventeenth aspect of the present invention, both the first filter part (124*a*) for protecting the first heat exchanger (61) and the second filter part (124*b*) for protecting the second heat exchanger (62) are arranged and formed along the inflow surface of outside air (OA) in each of the heat exchangers (61, 62). This therefore inhibits the rise in pressure loss due to the installation of each of the filter parts (124*a*, 124*b*).

According to the eighteenth aspect of the present invention, the first filter part (124*a*) and the second filter part (124*b*) are formed integrally with each other. This therefore makes it possible to compactedly design the outdoor filter (124). In addition, the outdoor filter (124) can be taken outside the casing (11) at a time for maintenance and its workability is improved.

According to the nineteenth aspect of the present invention, the first filter part (124*a*) and the second filter part (124*b*) are disposed adjacently to each other and may be formed into a single flat plate-like shape or a sheet-like shape. This therefore makes it possible to further compactedly design the outdoor filter (124). In addition, the installability of the outdoor filter (124) is improved.

According to the twentieth aspect of the present invention, it is designed such that the outdoor filter (124) can be taken, through the take-out opening (161), outside the casing (11). This therefore makes it possible to improve the maintainability of the outdoor filter (124).

According to the twenty-first aspect of the present invention, during the first and second operations, dust particles trapped in the outdoor filter (124) are blown away by room air (RA) and these dust particles are discharged to the outdoor space together with the room air (RA). Consequently, by alternately switchingly running the first operation and the second operation, dust particles adhering to the outdoor filter (124) can be automatically removed therefrom, thereby preventing the outdoor filter (124) from being clogged with dust. This therefore inhibits the rise in pressure loss in the outdoor filter (124). In addition, it becomes possible to reduce the frequency of replacement and maintenance of the outdoor filter (124).

According to the twenty-second aspect of the present invention, by alternately switchingly running the first operation and the second operation, dust particles adhering to the outdoor filter (124) are removed therefrom by room air (RA), thereby making it possible to inhibit the outdoor filter (124) from being clogged with dust. On the other hand, dust particles present in the room air (RA) are trapped by the indoor filter (123*b*). Accordingly, dust particles present in the room air (RA) are inhibited from adhering to the first and second heat exchangers (61, 62).

According to the twenty-third aspect of the present invention, the indoor filter (123*b*) is provided in addition to the provision of the outdoor filter (124), whereby dust particles present in room air (RA) are inhibited from adhering to the heat exchangers (61, 62).

According to the twenty-fourth aspect of the present invention, the indoor filter (123*b*) is disposed at the suction opening (163) which faces towards the indoor space. Consequently, the indoor filter (123*b*) can be easily removed from the side of the indoor space. Accordingly, it becomes possible to accomplish improvement in workability of the replacement and maintenance of the indoor filter (123*b*).

BRIEF DESCRIPTION OF THE DRAWINGS

FIG. 2, comprised of FIGS. 2(A), 2(B), and 2(C), is a schematic constructional diagram of the humidity control system of the first embodiment, wherein FIG. 2(A) is a view taken in the direction of arrows X-X of FIG. 2(B), FIG. 2(B) is a top plan view of the humidity control system, and FIG. 2(C) is a view taken in the direction of arrows Y-Y of FIG. 2(B);

FIG. 3, comprised of FIGS. 3(A) and 3(B), is a piping system diagram of a refrigerant circuit of the first embodiment, wherein FIG. 3(A) is a diagram which shows a state in a first refrigeration cycle operation and FIG. 3(B) is a diagram which shows a state in a second refrigeration cycle operation;

FIG. 4, comprised of FIGS. 4(A), 4(B), and 4(C), is a schematic constructional diagram of the humidity control system showing the flow of air in a first operation of the dehumidification mode, wherein FIG. 4(A) is a view taken in the direction of arrows X-X of FIG. 4(B), FIG. 4(B) is a top plan view of the humidity control system, and FIG. 4(C) is a view taken in the direction of arrows Y-Y of FIG. 4(B);

FIG. 5, comprised of FIGS. 5(A), 5(B), and 5(C), is a schematic constructional diagram of the humidity control system showing the flow of air in a second operation of the dehumidification mode, wherein FIG. 5(A) is a view taken in the direction of arrows X-X of FIG. 5(B), FIG. 5(B) is a top plan view of the humidity control system, and FIG. 5(C) is a view taken in the direction of arrows Y-Y of FIG. 5(B);

FIG. 6, comprised of FIGS. 6(A), 6(B), and 6(C), is a schematic constructional diagram of the humidity control system showing the flow of air in a first operation of the humidification mode, wherein FIG. 6(A) is a view taken in the direction of arrows X-X of FIG. 6(B), FIG. 6(B) is a top plan view of the humidity control system, and FIG. 6(C) is a view taken in the direction of arrows Y-Y of FIG. 6(B);

FIG. 7, comprised of FIGS. 7(A), 7(B), and 7(C), is a schematic constructional diagram of the humidity control system showing the flow of air in a second operation of the humidification mode, wherein FIG. 7(A) is a view taken in the direction of arrows X-X of FIG. 7(B), FIG. 7(B) is a top plan view of the humidity control system, and FIG. 7(C) is a view taken in the direction of arrows Y-Y of FIG. 7(B);

FIG. 8, comprised of FIGS. 8(A), 8(B), and 8(C), is a schematic constructional diagram of a humidity control system of a variation of the first embodiment, wherein FIG. 8(A) is a view taken in the direction of arrows X-X of FIG. 8(B), FIG. 8(B) is a top plan view of the humidity control system, and FIG. 8(C) is a view taken in the direction of arrows Y-Y of FIG. 8(B);

FIG. 9, comprised of FIGS. 9(A), 9(B), and 9(C), is a schematic constructional diagram of a humidity control system according to a second embodiment of the present invention, wherein FIG. 9(A) is a view taken in the direction of arrows X-X of FIG. 9(B), FIG. 9(B) is a top plan view of the humidity control system, and FIG. 9(C) is a view taken in the direction of arrows Y-Y of FIG. 9(B);

FIG. 10, comprised of FIGS. 10(A), 10(B), and 10(C), is a schematic constructional diagram of a humidity control system according to a third embodiment of the present invention, wherein FIG. 10(A) is a view taken in the direction of arrows X-X of FIG. 10(B), FIG. 10(B) is a top plan view of the humidity control system, and FIG. 10(C) is a view taken in the direction of arrows Y-Y of FIG. 10(B);

FIG. 11, comprised of FIGS. 11(A), 11(B), and 11(C), is a schematic constructional diagram of a humidity control system according to a fourth embodiment of the present invention, wherein FIG. 11(A) is a view taken in the direction of arrows X-X of FIG. 11(B), FIG. 11(B) is a top plan view of the humidity control system, and FIG. 11(C) is a view taken in the direction of arrows Y-Y of FIG. 11(B);

FIG. 12, comprised of FIGS. 12(A), 12(B), and 12(C), is a schematic constructional diagram of a humidity control system according to a fifth embodiment of the present invention, wherein FIG. 12(A) is a view taken in the direction of arrows X-X of FIG. 12(B), FIG. 12(B) is a top plan view of the humidity control system, and FIG. 12(C) is a view taken in the direction of arrows Y-Y of FIG. 12(B);

FIG. 13, comprised of FIGS. 13(A), 13(B), 13(C), and 13(D), is a schematic constructional diagram of a humidity control system according to a sixth embodiment of the present invention, wherein FIG. 13(A) is a top plan view of the humidity control system, FIG. 13(B) is a view of the inside of the humidity control system when viewed from the left hand side, FIG. 13(C) is a view of the inside of the humidity control system when viewed from the right hand side, and FIG. 13(D) is a cross section view taken along line D-D of FIG. 13(A);

FIG. 14, comprised of FIGS. 14(A), 14(B), and 14(C), is a schematic constructional diagram of the humidity control system showing the flow of air in a first operation, wherein FIG. 14(A) is a top plan view of the humidity control system, FIG. 14(B) is a view of the inside of the humidity control system when viewed from the left hand side, and FIG. 14(C) is a view of the inside of the humidity control system when viewed from the right hand side;

FIG. 15, comprised of FIGS. 15(A), 15(B), and 15(C), is a schematic constructional diagram of the humidity control system showing the flow of air in a first operation, wherein FIG. 15(A) is a cross section view of the humidity control system when viewed from the left hand side, FIG. 15(B) is a cross section view taken along line B-B of FIG. 15(A), and FIG. 15(C) is a cross section view taken along line C-C of FIG. 15(A);

FIG. 16, comprised of FIGS. 16(A), 16(B), and 16(C), is a schematic constructional diagram of the humidity control system showing the flow of air in a second operation, wherein FIG. 16(A) is a top plan view of the humidity control system, FIG. 16(B) is a view of the inside of the humidity control system when viewed from the left hand side, and FIG. 16(C) is a view of the inside of the humidity control system when viewed from the right hand side;

FIG. 17, comprised of FIGS. 17(A), 17(B), and 17(C), is a schematic constructional diagram of the humidity control system showing the flow of air in a second operation, wherein FIG. 17(A) is a cross section view of the humidity control system when viewed from the left hand side, FIG. 17(B) is a cross section view taken along line B-B of FIG. 17(A), and FIG. 17(C) is a cross section view taken along line C-C of FIG. 17(A);

FIG. 18, comprised of FIGS. 18(A), 18(B), 18(C), and 18(D), is a schematic constructional diagram of a humidity control system according to a first variation of the sixth embodiment, wherein FIG. 18(A) is a top plan view of the humidity control system, FIG. 18(B) is a view of the inside of the humidity control system when viewed from the left hand side, FIG. 18(C) is a view of the inside of the humidity control system when viewed from the right hand side, and FIG. 18(D) is a cross section view taken along line D-D of FIG. 18(A);

REFERENCE NUMERALS IN THE DRAWINGS

Figure 1:
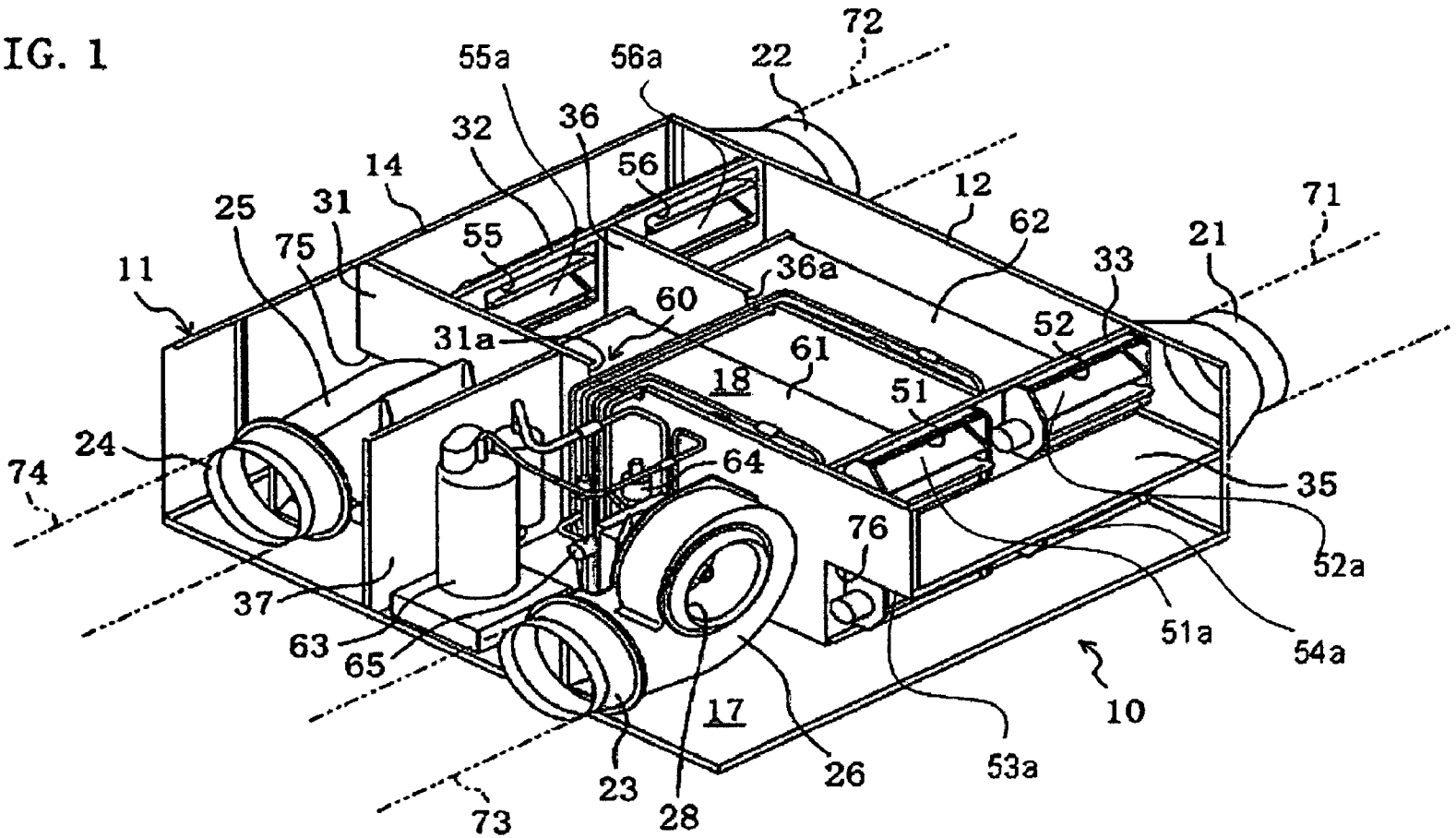
FIG. 1 is a perspective view of a humidity control system according to a first embodiment of the present invention.

10: humidity control system
11: casing
12: first lateral plate
13: second lateral plate (fan side lateral plate)
17: first space
18: second space

21: outside air inlet opening
22: inside air inlet opening
23: exhaust air outlet opening (air exhausting opening)
24: supply air outlet opening (air supplying opening)
25: air supplying fan
26: air exhausting fan
27: inlet opening
41: first heat exchange chamber (first passageway)
42: second heat exchange chamber (second passageway)
43: first inflow path
44: first outflow path
45: second inflow path
46: second outflow path
60: refrigerant circuit
61: first heat exchanger
62: second heat exchanger
63: compressor
64: four-way valve (reversal mechanism)
65: motor operated expansion valve (expansion mechanism)
123*b*: second pre-filter (indoor filter)
124: outdoor filter

BEST MODE FOR CARRYING OUT THE INVENTION

Hereinafter, preferred embodiments of the present invention are described with reference to the drawing figures. It should be noted, however, that the following embodiments are essentially preferable examples which are not meant to limit the present invention, its application, or its range of application.

First Embodiment of the Invention

In the following, a first embodiment of the present invention is described in detail with reference to the drawings.

Figure 2:
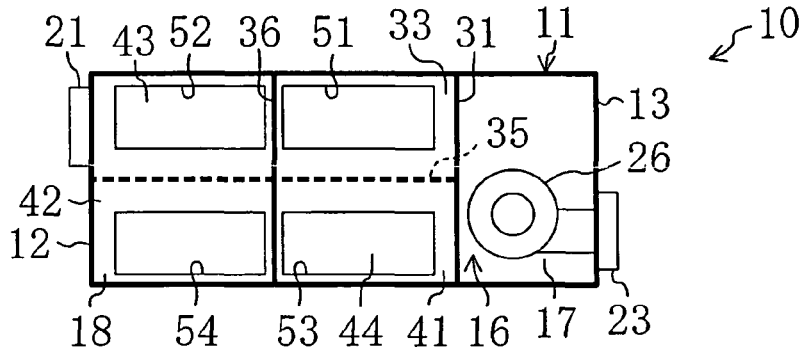
Figure 2:
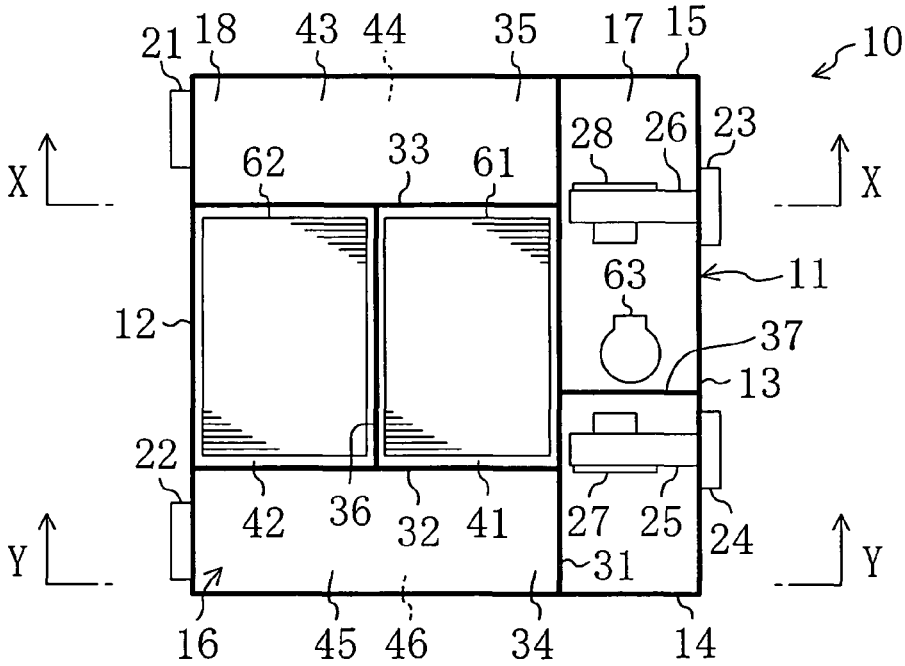
Figure 2:
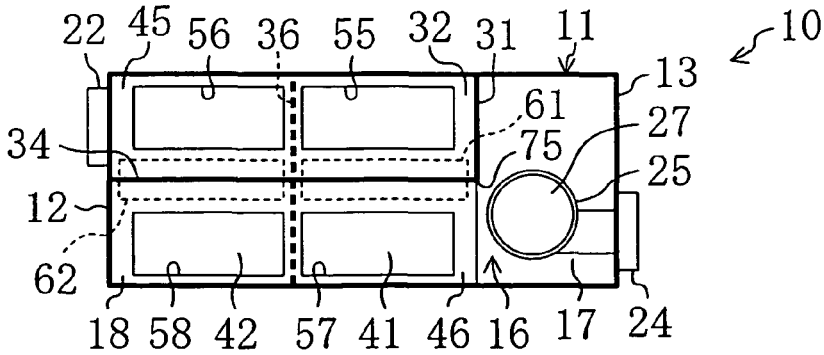

As shown in FIGS. 1 and 2, the present embodiment provides a humidity control system (10) for room air dehumidification/humidification. The humidity control system (10) includes a box-shaped casing (11) and is horizontally laid out in, for example, an under-roof space. Referring to FIG. 2, FIG. 2(B) is a top plan view, FIG. 2(C) is a diagram as viewed from the direction of arrow Y, and FIG. 2(A) is a diagram as viewed from the direction of arrow X. In addition, the positional terms "right" and "left" used in the following description mean, respectively, "the right-hand side" and "the left-hand side" in FIG. 2. FIG. 1 is a perspective view of the humidity control system (10), as viewed from the upper right hand side of FIG. 2.

The casing (11) accommodates therein components such as a refrigerant circuit (60). The refrigerant circuit (60) is a closed circuit which is provided with a first heat exchanger (61), a second heat exchanger (62), a compressor (63), a four-way valve (64) as a reversal mechanism, and a motor operated expansion valve (65) as an expansion mechanism. The refrigerant circuit (60) is filled up with refrigerant. In the refrigerant circuit (60), a vapor compression refrigeration cycle is performed by reversible circulation of the filled refrigerant. Details about the refrigerant circuit (60) will be discussed later.

As shown in FIG. 2, the casing (11) is shaped like a flattened box which is approximately square when viewed from above. The casing (11) has a left hand lateral plate, a right hand lateral plate, a front lateral plate, and a rear lateral plate. The left hand lateral plate is formed by a first lateral plate (12). The right hand lateral plate is formed by a second lateral plate (13) as a fan side lateral plate. The front lateral plate is formed by a third lateral plate (14). The rear lateral plate is formed by a fourth lateral plate (15). Note that FIG. 1 omits diagrammatic representation of the second and fourth lateral plates (13, 15) and the top plate.

An outside air inlet opening (21) is formed in the first lateral plate (12) (i.e., the left hand lateral plate of the casing (11)). More specifically, the outside air inlet opening (21) is located at an upper side portion of the first lateral plate (12) on the side of the fourth lateral plate (15) (i.e., the rear lateral plate of the casing (11)). In addition, an inside air inlet opening (22) is also formed in the first lateral plate (12). More specifically, the inside air inlet opening (22) is located at an upper side portion of the first lateral plate (12) on the side of the third lateral plate (14) (i.e., the front lateral plate of the casing (11)). On the other hand, an exhaust air outlet opening (23) is formed in the second lateral plate (13) (i.e., the right hand lateral plate of the casing (11)). More specifically, the exhaust air outlet opening (23) is located in the second lateral plate (13) on the side of the fourth lateral plate (15). In addition, a supply air outlet opening (24) is also formed in the second lateral plate (13). More specifically, the supply air outlet opening (24) is located in the second lateral plate (13) on the side of the third lateral plate (14).

As indicated by chain double-dashed line in FIG. 1, an outside air inlet duct (71) is fluidly connected to the outside air inlet opening (21) of the first lateral plate (12) in the casing (11), while a room air inlet duct (72) is fluidly connected to the inside air inlet opening (22) of the first lateral plate (12) in the casing (11). On the other hand, an exhaust air outlet duct (73) is fluidly connected to the exhaust air outlet opening (23) of the second lateral plate (13) in the casing (11), while a supply air outlet duct (74) is fluidly connected to the supply air outlet opening (24) of the second lateral plate (13) in the casing (11). In the way as described above, the inside of the casing (11) is brought into fluid communication with the inside and outside of the room.

As shown in FIG. 2, a first partition plate (31) is so mounted as to stand in the inside of the casing (11). The first partition plate (31) is located nearer to the second lateral plate (13) than the horizontal center of the casing (11). The casing (11) has an internal space (16) which is divided by the first partition plate (31) into right and left hand portions of which the former on the right hand side of the first partition plate (31) becomes a first space (17) and of which the latter on the left hand side of the first partition plate (31) becomes a second space (18).

A seventh partition plate (37) is mounted such that it stands in the inside of the first space (17) of the casing (11). The seventh partition plate (37) is located on the side of the third lateral plate (14). The first space (17) is divided by the seventh partition plate (37) into two portions. Of the two portions as a result of division of the first space (17) by the seventh partition plate (37), one on the side of the third lateral plate (14) houses therein an air supplying fan (25) and the other on the side of the fourth lateral plate (15) houses therein an air exhausting fan (26). The air supplying fan (25) and the air exhausting fan (26) are each formed by a multi-blade fan which draws in air from a lateral side of a fan casing thereof and then delivers it in a forward direction.

The compressor (63) of the refrigerant circuit (60) is disposed on the side of the fourth lateral plate (15) of the first space (17) such that the compressor (63) is sandwiched between the air supplying fan (25) and the air exhausting fan (26). In addition, as illustrated in FIG. 1, the motor operated expansion valve (65) and the four-way valve (64) in the refrigerant circuit (60) are also disposed in the first space (17) on the side of the fourth lateral plate (15). Furthermore, the air exhausting fan (26) is fluidly connected to the exhaust air outlet opening (23). The air supplying fan (25) is fluidly connected to the supply air outlet opening (24).

Mounted in the second space (18) of the casing (11) are a second partition plate (32), a third partition plate (33), and a sixth partition plate (36). The second partition plate (32) is mounted such that it stands on the side of the third lateral plate (14) and the third partition plate (33) is mounted such that it stands on the side of the fourth lateral plate (15). And the second space (18) is divided, in the direction from the front to the rear side, by the second and third partition plates (32, 33) into three spaces. The sixth partition plate (36) is mounted in a space sandwiched between the second partition plate (32) and the third partition plate (33). The sixth partition plate (36) is mounted in the second space (18) such that it stands centrally relative to the horizontal width direction of the second space (18).

The space defined between the second partition plate (32) and the third partition plate (33) is divided by the sixth partition plate (36) into right and left hand spaces of which the former on the right hand side of the sixth partition plate (36) constitutes a first heat exchange chamber (41) in which is disposed the first heat exchanger (61) and of which the latter on the left hand side of the sixth partition plate (36) constitutes a second heat exchange chamber (42) in which is disposed the second heat exchanger (62).

An opening (31*a*) for piping arrangement, for establishing fluid communication between the first heat exchange chamber (41) and the first space (17), is formed in a longitudinally central upper side portion of the first partition plate (31). In addition, an opening (36*a*) for piping arrangement is formed also in a longitudinally central upper side portion of the sixth partition plate (36).

Each of the heat exchangers (61, 62) is formed, in whole, into a thick, flat plate-like shape. The first heat exchanger (61) is so disposed as to traverse horizontally across the first heat exchange chamber (41). Likewise, the second heat exchanger (62) is so disposed as to traverse horizontally across the second heat exchange chamber (42). Details about the first and second heat exchangers (61, 62) will be discussed later.

A fifth partition plate (35) is mounted in a space of the second space (18) that is defined between the third partition plate (33) and the fourth lateral plate (15) of the casing (11). The fifth partition plate (35) is so mounted as to traverse across a heightwise central portion of the space of the second space (18), in other words the space of the second space (18) is divided by the fifth partition plate (35) into upper and lower spaces (see FIG. 2(A)), of which the former overlying the fifth partition plate (35) constitutes a first inflow path (43) and of which the later underlying the fifth partition plate (35) constitutes a first outflow path (44). In addition, the first inflow path (43) is in fluid communication with the outside air inlet opening (21), while the first outflow path (44) is in fluid communication, via a second fan side communication opening (76) of the first partition plate (31) and the air exhausting fan (26), with the exhaust air outlet opening (23).

On the other hand, a fourth partition plate (34) is mounted in a space of the second space (18) that is defined between the second partition plate (32) and the third lateral plate (14) of the casing (11). The fourth partition plate (34) is so mounted as to traverse across a heightwise central portion of the space of the second space (18), in other words the space of the second space (18) is divided by the fourth partition plate (34) into upper and lower spaces (see FIG. 2(C)), of which the former overlying the fourth partition plate (34) constitutes a second inflow path (45) and of which the latter underlying the fourth partition plate (34) constitutes a second outflow path (46). In addition, the second inflow path (45) is in fluid communication with the inside air inlet opening (22), while the second outflow path (46) is in fluid communication, via a first fan side communication opening (75) of the first partition plate (31) and the air supplying fan (25), with the supply air outlet opening (24).

Referring to FIG. 2(A), four openings (51, 52, 53, 54) are provided in the third partition plate (33). The first opening (51), formed in an upper right hard portion of the third partition plate (33), allows fluid communication between the portion of the first heat exchange chamber (41) situated above the first heat exchanger (61) and the first inflow path (43). The second opening (52), formed in an upper left hand portion of the third partition plate (33), allows fluid communication between the portion of the second heat exchange chamber (42) situated above the second heat exchanger (62) and the first inflow path (43). The third opening (53), formed in a lower right hand portion of the third partition plate (33), allows fluid communication between the portion of the first heat exchange chamber (41) situated under the first heat exchanger (61) and the first outflow path (44). The fourth opening (54), formed in a lower left hand portion of the third partition plate (33), allows fluid communication between the portion of the second heat exchange chamber (42) situated under the second heat exchanger (62) and the first outflow path (44).

Referring to FIG. 2(C), four openings (55, 56, 57, 58) are provided in the second partition plate (32). The fifth opening (55), formed in an upper right hand portion of the second partition plate (32), allows fluid communication between the portion of the first heat exchange chamber (41) situated above the first heat exchanger (61) and the second inflow path (45). The sixth opening (56), formed in an upper left hand portion of the second partition plate (32), allows fluid communication between the portion of the second heat exchange chamber (42) situated above the second heat exchanger (62) and the second inflow path (45). The seventh opening (57), formed in a lower right hand portion of the second partition plate (32), allows fluid communication between the portion of the first heat exchange chamber (41) situated under the first heat exchanger (61) and the second outflow path (46). The eighth opening (58), formed in a lower left hand portion of the second partition plate (32), allows fluid communication between the portion of the second heat exchange chamber (42) situated under the second heat exchanger (62) and the second outflow path (46).

Each of the openings (51, 52, 53, 54) of the third partition plate (33) is provided with a respective openable/closable damper (not shown). Likewise, each of the openings (55, 56, 57, 58) of the second partition plate (32) is provided with a respective openable/closable damper (55*a*, 56*a*, 57*a*, 58*a*). Each opening (51, . . . , 55, . . . ) can selectively switch its state between the open state and the closed state by the opening/closing operation of its associated damper. This makes it possible to change the distribution route of air in the casing (11) depending on the circulation direction of refrigerant in the refrigerant circuit (60).

Figure 3:
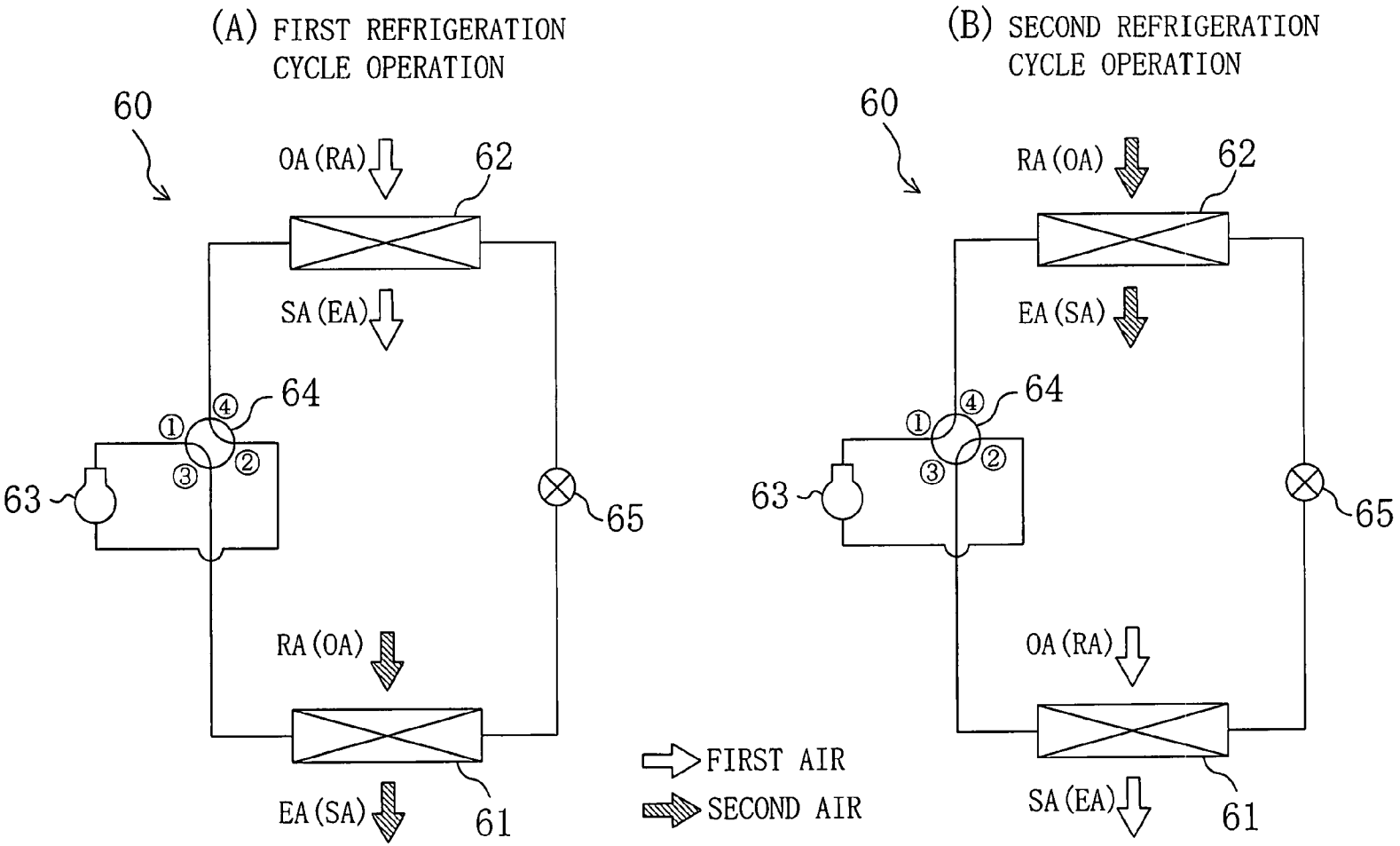

Referring to FIGS. 1 and 3, the refrigerant circuit (60) is described.

The compressor (63) is fluidly connected, at its discharge side, to a first port of the four-way valve (64) and its suction side is fluidly connected, through the piping arrangement opening (31*a*) of the first partition plate (31), to a second port of the four-way valve (64). One end of the first heat exchanger (61) is fluidly connected, through the piping arrangement opening (31*a*), to a third port of the four-way valve (64). The other end of the first heat exchanger (61) is fluidly connected, through the piping arrangement opening (31*a*), to the motor operated expansion valve (65), and is fluidly connected, again through the piping arrangement opening (31*a*) and next through the piping arrangement opening (36*a*) of the sixth partition plate (36), to one end of the second heat exchanger (62). The other end of the second heat exchanger (62) is fluidly connected, through the piping arrangement openings (31*a*, 36*a*), to a fourth port of the four-way valve (64).

The compressor (63) is of the so-called hermetical type. Although not shown diagrammatically, the electric motor for the compressor (63) is supplied with electric power through an inverter.

The first and second heat exchangers (61, 62) are each formed by a respective fin and tube heat exchanger of the so-called cross fin type provided with a heat transfer tube and a large number of fins. In addition, the first and second heat exchangers (61, 62) support, approximately all over their respective outer surfaces, an adsorbent such as zeolite et cetera.

The four-way valve (64) is configured such that its operation is selectively switchable between a first state (as indicated in FIG. 3(A)) in which the first and third ports are brought into fluid communication with each other and the second and fourth ports are brought into fluid communication with each other, and a second state (as indicated in FIG. 3(B)) in which the first and fourth ports are brought into fluid communication with each other and the second and third ports are brought into fluid communication with each other. The refrigerant circuit (60) is configured such that the circulation direction of refrigerant is reversed by changing the state of the four-way valve (64), whereby the refrigerant circuit (60) is allowed to selectively switch its operation between a first refrigeration cycle operation in which the first heat exchanger (61) functions as a condenser while the second heat exchanger (62) functions as an evaporator, and a second refrigeration cycle operation in which the first heat exchanger (61) functions as an evaporator while the second heat exchanger (62) functions as a condenser.

Humidity Control Operation of the Humidity Control System

How the humidity control system (10) provides humidity control is described. The humidity control system (10) has selectable dehumidification and humidification modes. In addition, in the humidity control system (10), during dehumidification and humidification modes, a first operation and a second operation are alternately repeatedly carried out at relatively short time intervals, for example, at time intervals of three minutes.

Dehumidification Mode

During the dehumidification mode, the air supplying fan (25) and the air exhausting fan (26) are brought into operation in the humidity control system (10). The humidity control system (10) draws in outside air (OA) as a first air stream and supplies it into an indoor space, while on the other hand the humidity control system (10) draws in room air (RA) as a second air stream and discharges it to an outdoor space.

Figure 4:
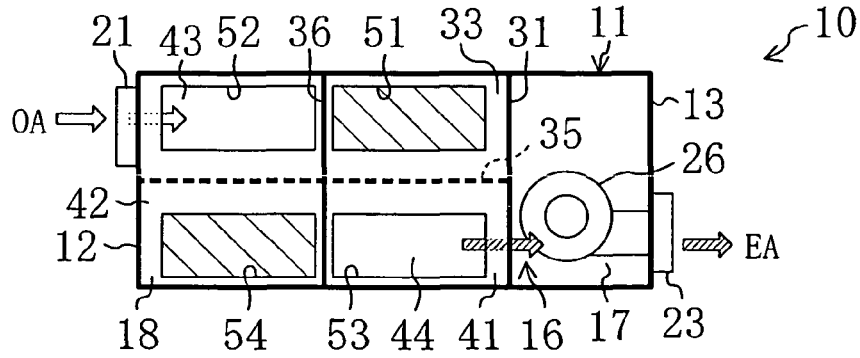
Figure 4:
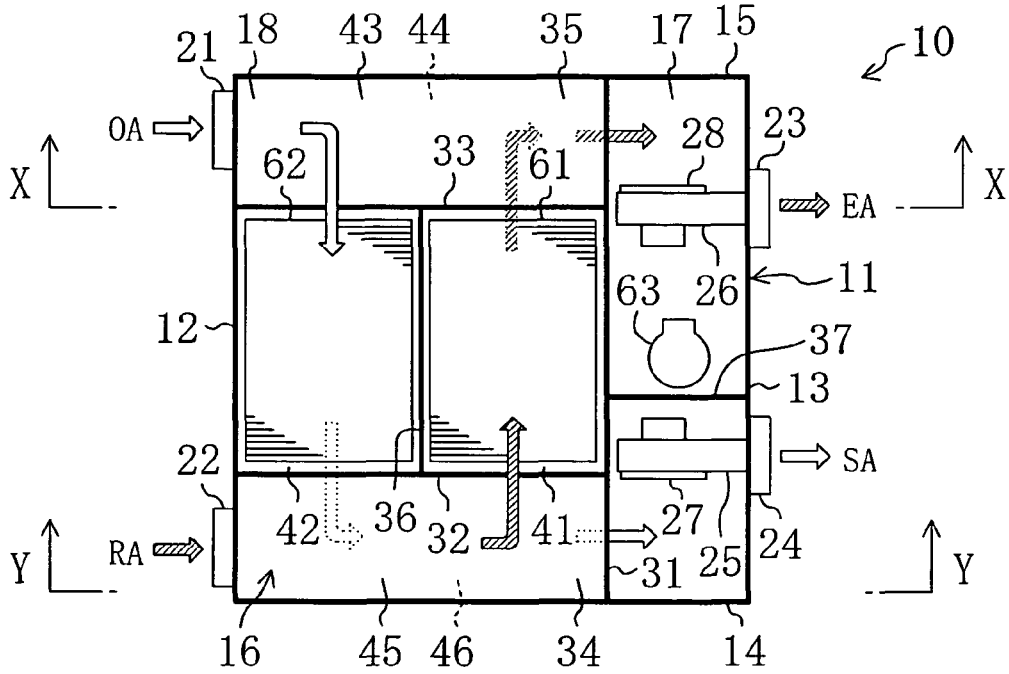
Figure 4:
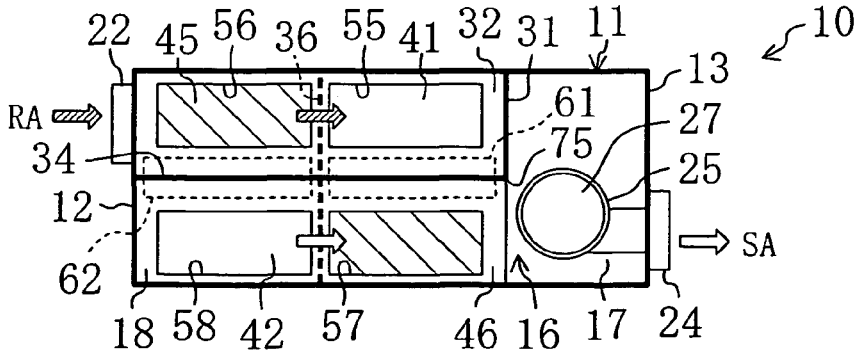

In the first place, a first operation of the dehumidification mode is described with reference to FIGS. 3 and 4. In the first operation, regeneration of the adsorbent of the first heat exchanger (61) is accomplished while dehumidification of the outside air (OA) as a first air stream is accomplished in the second heat exchanger (62).

In the first operation, the four-way valve (64) in the refrigerant circuit (60) is switched to a state as indicated in FIG. 3(A). When in the state of FIG. 3(A) the compressor (63) is brought into operation, refrigerant is circulated in the refrigerant circuit (60) so that a first refrigeration cycle operation is performed in which the first heat exchanger (61) becomes a condenser and the second heat exchanger (62) becomes an evaporator.

More specifically, the refrigerant discharged from the compressor (63) dissipates heat and is condensed in the first heat exchanger (61). Subsequently, the refrigerant is delivered to the motor operated expansion valve (65) where it is reduced in pressure. The pressure reduced refrigerant absorbs heat and is evaporated in the second heat exchanger (62). Then, the refrigerant is drawn into the compressor (63) where it is compressed. And, the compressed refrigerant is again discharged from the compressor (63).

In addition, in the first operation, the second opening (52), the third opening (53), the fifth opening (55), and the eighth opening (58) are placed in the open state, while the first opening (51), the fourth opening (54), the sixth opening (56), and the seventh opening (57) are placed in the closed state. And, as illustrated in FIG. 4, room air (RA) as a second air stream is supplied to the first heat exchanger (61) and outside air (OA) as a first air stream is supplied to the second heat exchanger (62).

More specifically, a second air stream as an inflow from the inside air inlet opening (22) is delivered, through the fifth opening (55), into the first heat exchange chamber (41) from the second inflow path (45). In the first heat exchange chamber (41), the second air stream is passed downward from above through the first heat exchanger (61). In the first heat exchanger (61), the adsorbent supported on the outer surface of the first heat exchanger (61) is heated by the refrigerant, and moisture is desorbed from the adsorbent. The moisture thus desorbed from the adsorbent is fed to the second air stream flowing through the first heat exchanger (61). The second air stream moisturized in the first heat exchanger (61) flows out to the first outflow path (44) from the first heat exchange chamber (41) through the third opening (53). Thereafter, the second air stream is drawn into the air exhausting fan (26) and is discharged, through the exhaust air outlet opening (23), to outside the indoor space as exhaust air (EA).

Meanwhile, a first air stream as an inflow from the outside air inlet opening (21) is delivered, through the second opening (52), into the second heat exchange chamber (42) from the first inflow path (43). In the second heat exchange chamber (42), the first air stream is passed downward from above through the second heat exchanger (62). In the second heat exchanger (62), moisture present in the first air stream is adsorbed by the adsorbent supported on the outer surface of the second heat exchanger (62). The resulting heat of adsorption is absorbed by the refrigerant. The first air stream dehumidified in the second heat exchanger (62) flows out to the second outflow path (46) from the second heat exchange chamber (42) through the eighth opening (58). Thereafter, the first air stream is drawn into the air supplying fan (25) and is supplied through the supply air outlet opening (24) into the indoor space as supply air (SA).

Figure 5:
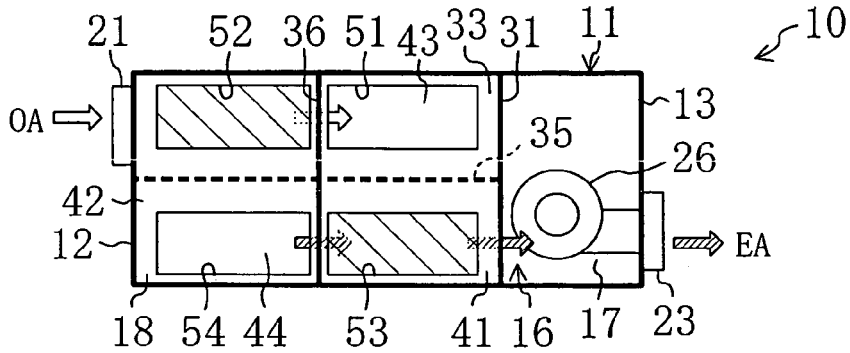
Figure 5:
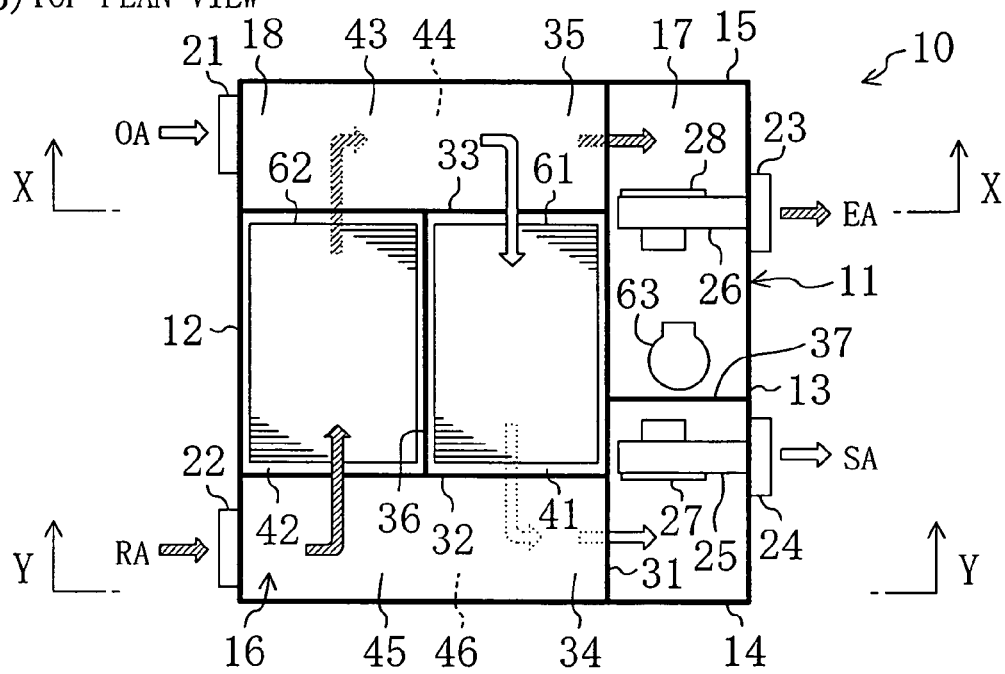
Figure 5:
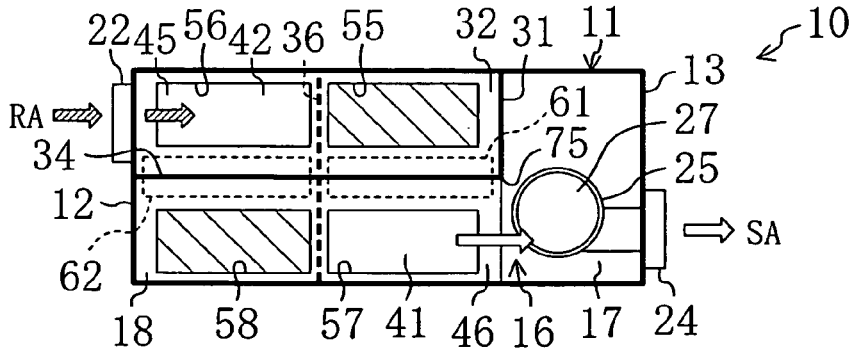

Next, a second operation of the dehumidification mode is described with reference to FIGS. 3 and 5. In the second operation, regeneration of the adsorbent of the second heat exchanger (62) is accomplished and dehumidification of the outside air (OA) as a first air stream is accomplished in the first heat exchanger (61).

In the second operation, the four-way valve (64) in the refrigerant circuit (60) is switched to a state as indicated in FIG. 3(B). When in the state of FIG. 3(B) the compressor (63) is brought into operation, the refrigerant is circulated in the refrigerant circuit (60) so that a second refrigeration cycle operation is performed in which the first heat exchanger (61) becomes an evaporator and the second heat exchanger (62) becomes a condenser.

More specifically, the refrigerant discharged from the compressor (63) dissipates heat and is condensed in the second heat exchanger (62). Subsequently, the refrigerant is delivered to the motor operated expansion valve (65) where it is reduced in pressure. The pressure reduced refrigerant absorbs heat and is evaporated in the first heat exchanger (61). Then, the refrigerant is drawn into the compressor (63) where it is compressed. And the compressed refrigerant is again discharged from the compressor (63).

In addition, in the second operation, the first opening (51), the fourth opening (54), the sixth opening (56), and the seventh opening (57) are placed in the open state, while the second opening (52), the third opening (53), the fifth opening (55), and the eighth opening (58) are placed in the closed state. And, as shown in FIG. 5, outside air (OA) as a first air stream is supplied to the first heat exchanger (61) and room air (RA) as a second air stream is supplied to the second heat exchanger (62).

More specifically, a second air stream as an inflow from the inside air inlet opening (22) is delivered, through the sixth opening (56), into the second heat exchange chamber (42) from the second inflow path (45). In the second heat exchange chamber (42), the second air stream is passed downward from above through the second heat exchanger (62). In the second heat exchanger (62), the adsorbent supported on the outer surface of the second heat exchanger (62) is heated by the refrigerant, and moisture is desorbed from the adsorbent. The moisture desorbed from the adsorbent is fed to the second air stream flowing through the second heat exchanger (62). The second air stream moisturized in the second heat exchanger (62) flows out to the first outflow path (44) from the second heat exchange chamber (42) through the fourth opening (54). Thereafter, the second air stream is drawn into the air exhausting fan (26) and is discharged, through the exhaust air outlet opening (23), to outside the indoor space as exhaust air (EA).

Meanwhile, a first air stream as an inflow from the outside air inlet opening (21) is delivered, through the first opening (51), into the first heat exchange chamber (41) from the first inflow path (43). In the first heat exchange chamber (41), the first air stream is passed downward from above through the first heat exchanger (61). In the first heat exchanger (61), moisture present in the first air stream is adsorbed by the adsorbent supported on the outer surface of the first heat exchanger (61). The resulting heat of adsorption is absorbed by the refrigerant. The first air stream dehumidified in the first heat exchanger (61) flows out to the second outflow path (46) from the first heat exchange chamber (41) through the seventh opening (57). Thereafter, the first air stream is drawn into the air supplying fan (25) and is supplied through the supply air outlet opening (24) to the indoor space as supply air (SA).

Humidification Mode

During the humidification mode, the air supplying fan (25) and the air exhausting fan (26) are brought into operation in the humidity control system (10). The humidity control system (10) draws in room air (RA) as a first air stream and discharges it to the outdoor space while the humidity control system (10) draws in outside air (OA) as a second air stream and supplies it into the indoor space.

Figure 6:
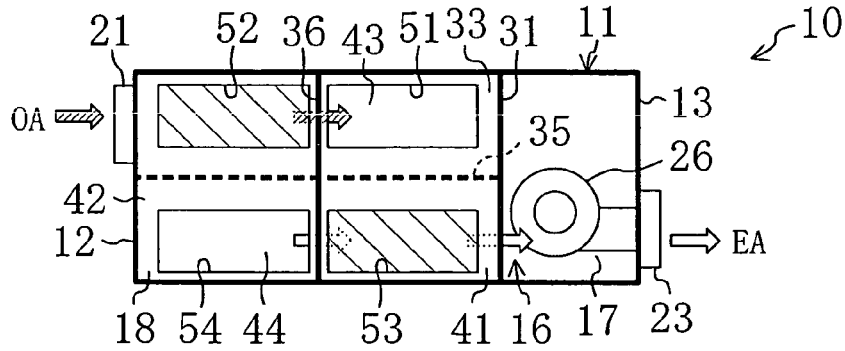
Figure 6:
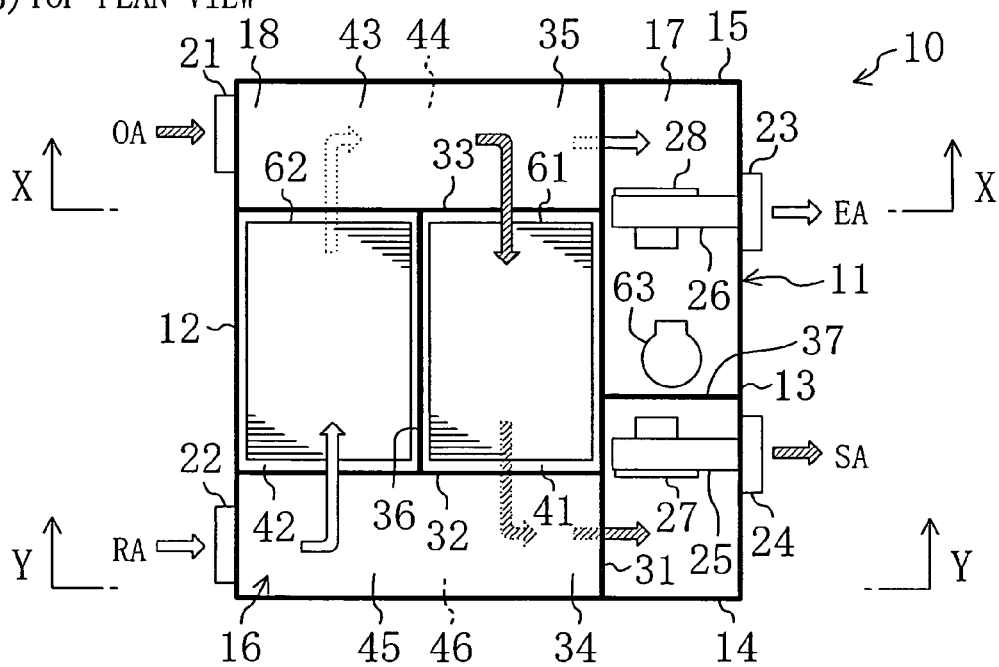
Figure 6:
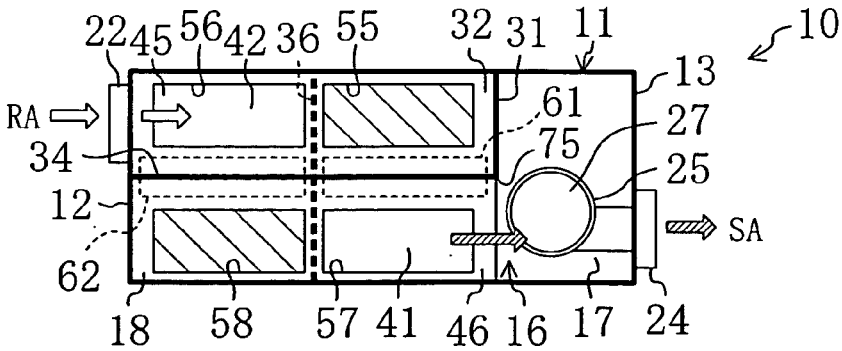

In the first place, a first operation of the humidification mode is described with reference to FIGS. 3 and 6. In the first operation, humidification of the outside air (OA) as a second air stream is accomplished in the first heat exchanger (61) and moisture recovery from the room air (RA) as a first air stream is accomplished in the second heat exchanger (62).

In the first operation, the four-way valve (64) in the refrigerant circuit (60) is switched to a state as indicated in FIG. 3(A). When in the state of FIG. 3(A) the compressor (63) is brought into operation, the refrigerant is circulated in the refrigerant circuit (60) so that a first refrigeration cycle operation is performed in which the first heat exchanger (61) becomes a condenser and the second heat exchanger (62) becomes an evaporator.

Additionally, in the first operation, the first opening (51), the fourth opening (54), the sixth opening (56), and the seventh opening (57) are placed in the open state, while the second opening (52), the third opening (53), the fifth opening (55), and the eighth opening (58) are placed in the closed state. As can be seen from FIG. 6, the first heat exchanger (61) is supplied with outside air (OA) as a second air stream while on the other hand the second heat exchanger (62) is supplied with room air (RA) as a first air stream.

More specifically, a first air stream as an inflow from the inside air inlet opening (22) is delivered, through the sixth opening (56), into the second heat exchange chamber (42) from the second inflow path (45). In the second heat exchange chamber (42), the first air stream is passed downward from above through the second heat exchanger (62). In the second heat exchanger (62), moisture present in the first air stream is adsorbed by the adsorbent supported on the outer surface of the second heat exchanger (62). The resulting heat of adsorption is absorbed by the refrigerant. Thereafter, the demoisturized first air stream sequentially passes through the fourth opening (54), then through the first outflow path (44), and then through the air exhausting fan (26) and is discharged through the exhaust air outlet opening (23) to outside the indoor space as exhaust air (EA).

On the other hand, a second air stream as an inflow from the outside air inlet opening (21) is delivered, through the first opening (51), into the first heat exchange chamber (41) from the first inflow path (43). In the first heat exchange chamber (41), the second air stream is passed downward from above through the first heat exchanger (61). In the first heat exchanger (61), the adsorbent supported on the outer surface of the first heat exchanger (61) is heated by the refrigerant, and moisture is desorbed from the adsorbent. The moisture desorbed from the adsorbent is fed to the second air stream flowing through the first heat exchanger (61). Thereafter, the humidified second air stream sequentially passes through the seventh opening (57), then through the second outflow path (46), and then through the air supplying fan (25) and is supplied through the supply air outlet opening (24) into the indoor space as supply air (SA).

Figure 7:
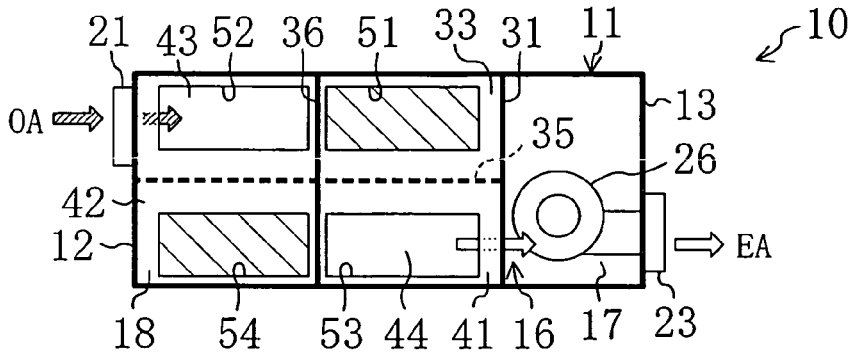
Figure 7:
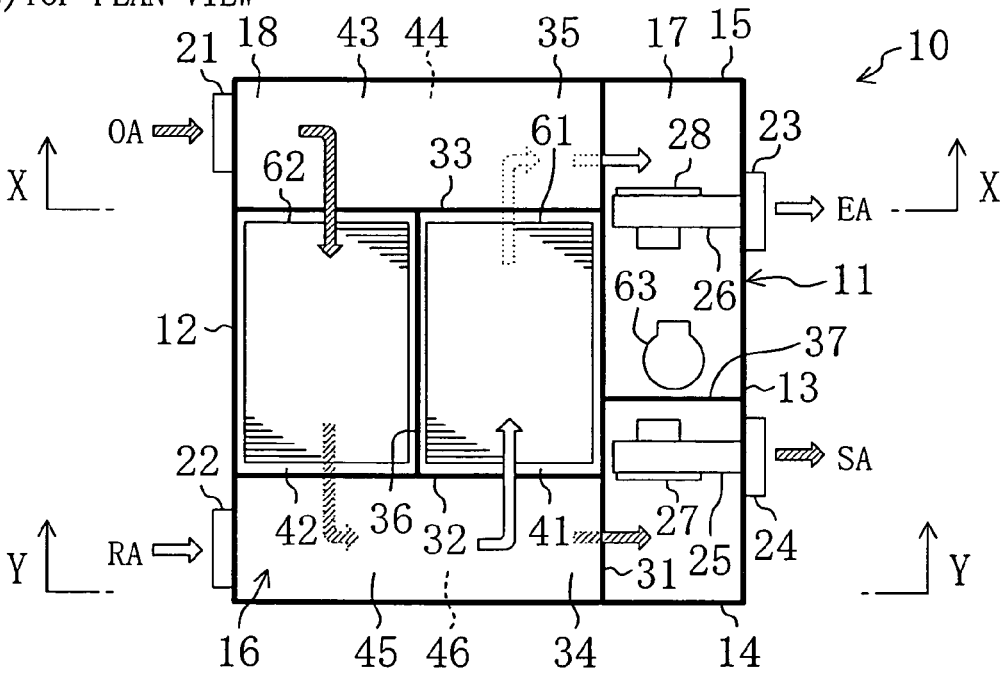
Figure 7:
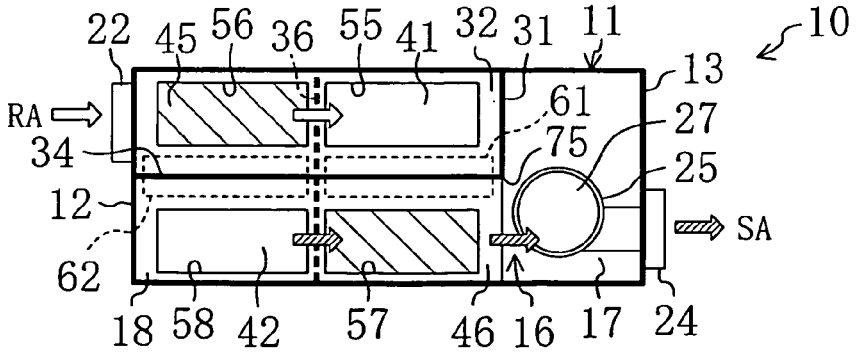

Next, a second operation of the humidification mode is described with reference to FIGS. 3 and 7. In the second operation, humidification of the outside air (OA) as a second air stream is accomplished in the second heat exchanger (62) and moisture recovery from the room air (RA) as a first air stream is accomplished in the first heat exchanger (61).

In the second operation, the four-way valve (64) in the refrigerant circuit (60) is switched to a state as indicated in FIG. 3(B). When in the state of FIG. 3(B) the compressor (63) is brought into operation, the refrigerant is circulated in the refrigerant circuit (60) so that a second refrigeration cycle operation is performed in which the first heat exchanger (61) becomes an evaporator and the second heat exchanger (62) becomes a condenser.

Additionally, in the second operation, the second opening (52), the third opening (53), the fifth opening (55), and the eighth opening (58) are placed in the open state, while the first opening (51), the fourth opening (54), the sixth opening (56), and the seventh opening (57) are placed in the closed state. As can be seen from FIG. 7, the first heat exchanger (61) is supplied with room air (RA) as a first air stream while the second heat exchanger (62) is supplied with outside air (OA) as a second air stream.

More specifically, a first air stream as an inflow from the inside air inlet opening (22) is delivered, through the fifth opening (55), into the first heat exchange chamber (41) from the second inflow path (45). In the first heat exchange chamber (41), the first air stream is passed downward from above through the first heat exchanger (61). In the first heat exchanger (61), moisture present in the first air stream is adsorbed by the adsorbent supported on the outer surface of the first heat exchanger (61). The resulting heat of adsorption is absorbed by the refrigerant. Thereafter, the demoisturized first air stream sequentially passes through the third opening (53), then through the first outflow path (44), and then through the air exhausting fan (26) and is discharged through the exhaust air outlet opening (23) to outside the indoor space as exhaust air (EA).

On the other hand, a second air stream as an inflow from the outside air inlet opening (21) is delivered, through the second opening (52), into the second heat exchange chamber (42) from the first inflow path (43). In the second heat exchange chamber (42), the second air stream is passed downward from above through the second heat exchanger (62). In the second heat exchanger (62), the adsorbent supported on the outer surface of the second heat exchanger (62) is heated by the refrigerant, and moisture is desorbed from the adsorbent. The moisture desorbed from the adsorbent is fed to the second air stream passing through the second heat exchanger (62). Thereafter, the humidified second air stream sequentially passes through the eighth opening (58), then through the second outflow path (46), and then through the air supplying fan (25) and is supplied through the supply air outlet opening (24) into the indoor space as supply air (SA).

Advantageous Effects of the First Embodiment

In the present embodiment, the compressor (63), the motor operated expansion valve (65), and the four-way valve (64) for reversing the circulation direction of refrigerant in the refrigerant circuit (60) are disposed together with the heat exchangers (61, 62) in the casing (11). This arrangement therefore makes it possible to ship and install a humidity control system with refrigerant filled therein, thereby facilitating the work of installing the humidity control system, and the pressure loss is reduced to thereby raise the condensing temperature, thereby making it possible to improve the efficiency of the humidity control system.

In the present embodiment, the first space (17) and the second space (18) are formed in the casing (11); the air supplying fan (25) and the air exhausting fan (26) are disposed in the second space (18) defined along the second lateral plate (13) which is a fan side lateral plate while the first and second heat exchangers (61, 62) and the switching mechanism are disposed in the first space (17). As a result of these arrangements, the casing (11) is downsized by appropriately optimizing the layout of the equipment in the casing (11), thereby providing a humidity control system (10) capable of easily being installed in a small space such as an under-roof space.

In addition, in the present embodiment, the compressor (63) of the refrigerant circuit (60) is disposed between the air supplying fan (25) and the air exhausting fan (26) in the first space (17). This therefore makes it possible to make efficient use of an empty space between the air supplying fan (25) and the air exhausting fan (26), thereby achieving further humidity control system downsizing.

Besides, in the present embodiment, the two heat exchangers (61, 62) are substantially horizontally laid out. As a result of such arrangement, a low-profile humidity control system is obtained.

In addition, in the present embodiment, the motor operated expansion valve (65) and the four-way valve (64) in the refrigerant circuit (60), in addition to the compressor (63), are also disposed in concentrated manner in the first space (17). This therefore makes it possible to achieve further space saving of the entire system.

Besides, the piping of the refrigerant circuit (60) which is fluidly connected to the first and second heat exchangers (61, 62) is arranged along the top plate of the casing (11). This piping arrangement makes it possible to install the refrigerant circuit (60) from above the casing (11) at the time of assembly of the humidity control system (10) as well as to perform maintenance work on the refrigerant circuit (60) from above the casing (11).

Variation of the First Embodiment

Figure 8:
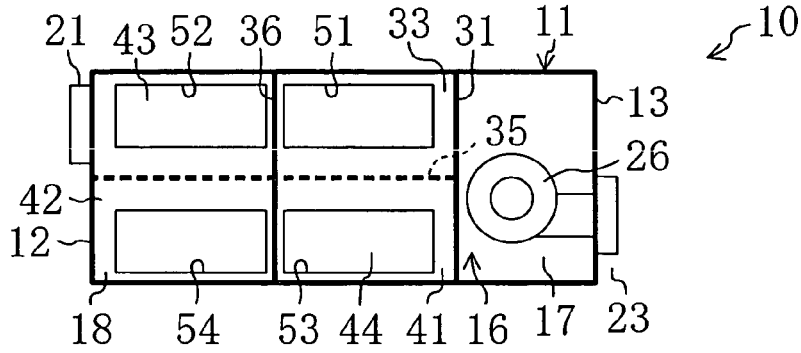
Figure 8:
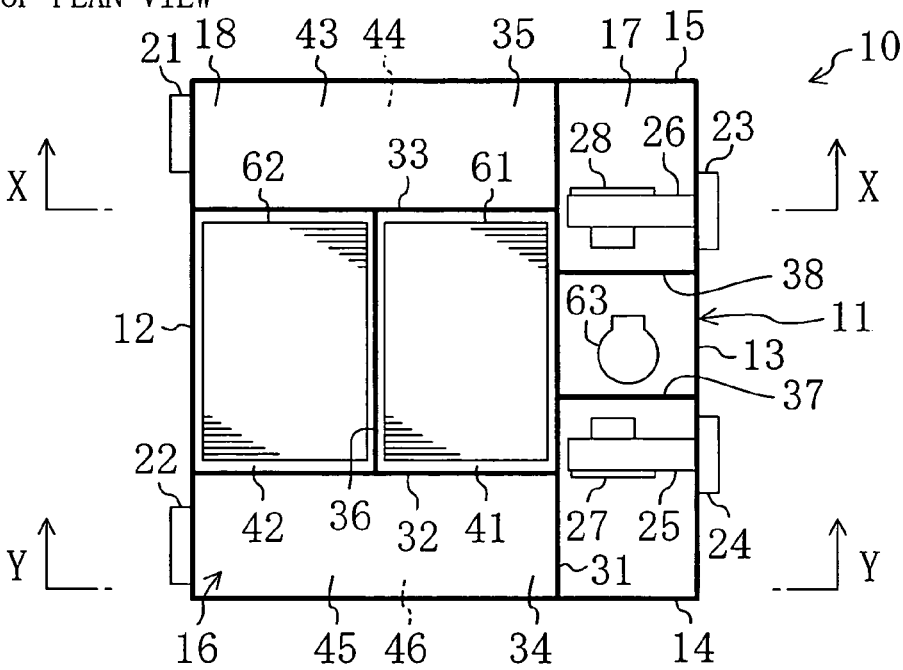
Figure 8:
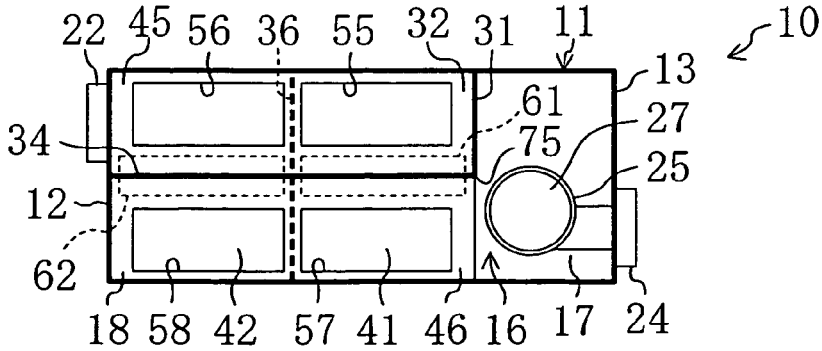

In the humidity control system (10) of the first embodiment, the interior of the first space (17) of the casing (11) is divided by the seventh partition plate (37) into two portions. Alternatively, it may be arranged such that an eighth partition plate (38) is provided so as to isolate the casing (11) from the air passageway, as shown in FIG. 8. In this case, the compressor (63) is blocked from the air passageway and, as a result, air which is supplied into the indoor space is not affected adversely by thermal radiation from the compressor (63) itself. Furthermore, differential pressure becomes less likely to be created between the first heat exchange chamber (41) and the first space (17) and, as a result, there is no air inflow towards the first space (17) from the first heat exchange chamber (41) by way of the piping arrangement opening (31*a*).

Figure 21:
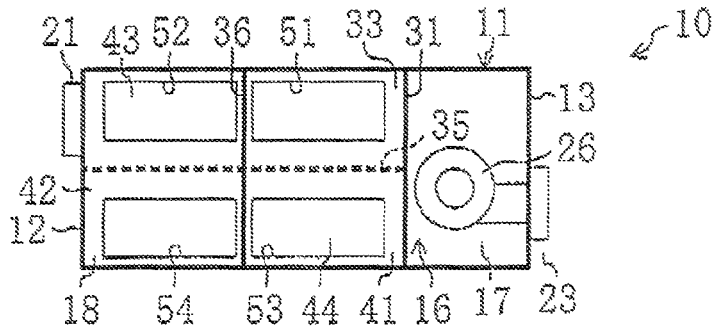
FIG. 21 is a schematic constructional constructional diagram of a humidity control system according to a second variation of the first embodiment.
Figure 21:
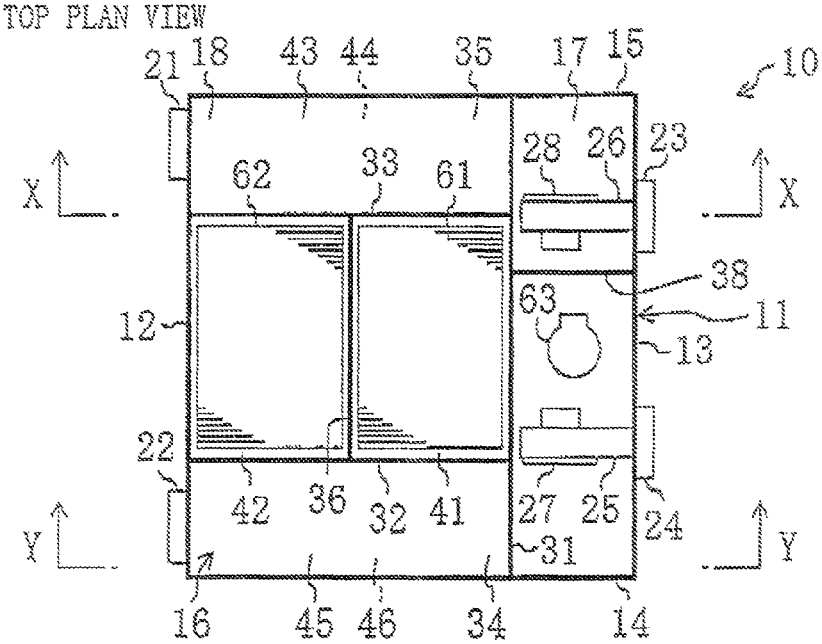
Figure 21:
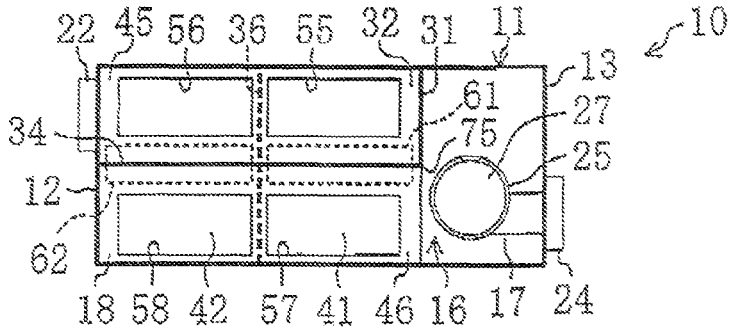

In addition, as shown in FIG. 21, it may be arranged such that, without the provision of the seventh partition plate (37), the interior of the first space (17) of the casing (11) may be divided by the eighth partition plate (38) alone. This provides an advantageous configuration in cases where room heating is given priority, because thermal radiation from the compressor (63) itself is absorbed by room air.

Second Embodiment of the Invention

Figure 9:
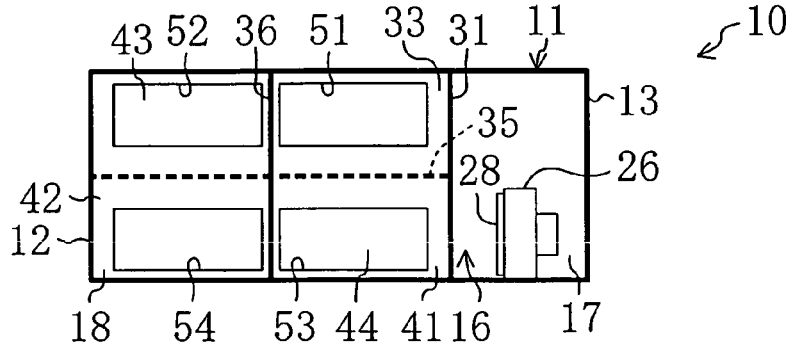
Figure 9:
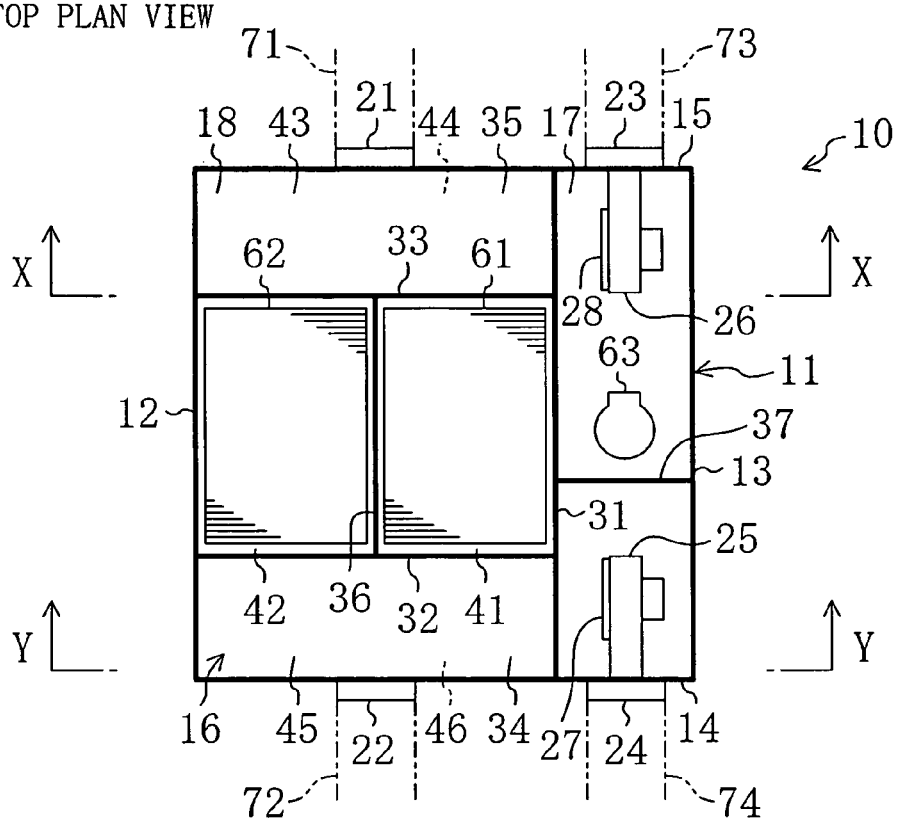
Figure 9:
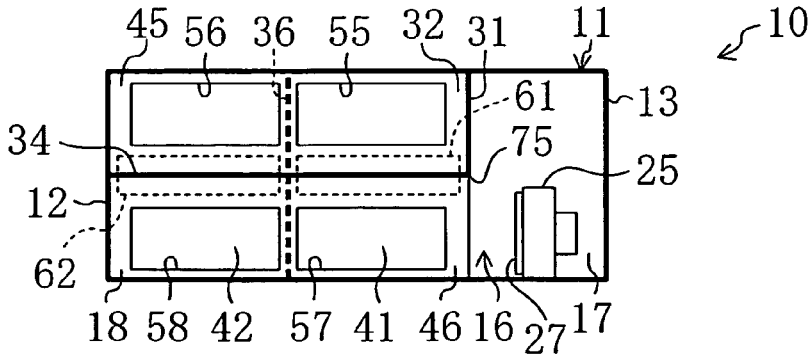

Referring now to FIG. 9, there is shown a second embodiment of the present invention. The second embodiment differs from the first embodiment in the layout position of each of the outside air inlet opening (21), the inside air inlet opening (22), the exhaust air outlet opening (23), and the supply air outlet opening (24). In each of the following embodiments of the present invention, the same reference numerals refer to the same parts in FIGS. 1-7 and their detailed description is omitted. In addition, the humidity control operation of the humidity control system (10) of the present embodiment is not described here since it is the same as the humidity control operation of the humidity control system (10) of the first embodiment.

The outside air inlet opening (21) and the exhaust air outlet opening (23) are formed in the fourth lateral plate (15) on the rear side of the casing (11). More specifically, the outside air inlet opening (21) is located at an upper side portion of the fourth lateral plate (15) on the side of the first lateral plate (12), while the exhaust air outlet opening (23) is located on the side of the second lateral plate (13). On the other hand, the supply air outlet opening (24) and the inside air inlet opening (22) are formed in the third lateral plate (14) on the front side of the casing (11). More specifically, the supply air outlet opening (24) is located on the side of the second lateral plate (13), while the inside air inlet opening (22) is located at an upper side portion of the third lateral plate (14) on the side of the first lateral plate (12).

As indicated by chain double-dashed line of FIG. 9, in the casing (11), the outside air inlet duct (71) is fluidly connected to the outside air inlet opening (21) of the fourth lateral plate (15) and the exhaust air outlet duct (73) is fluidly connected to the exhaust air outlet opening (23) of the fourth lateral plate (15), while the room air inlet duct (72) is fluidly connected to the inside air inlet opening (22) of the third lateral plate (14) and the supply air outlet duct (74) is fluidly connected to the supply air outlet opening (24) of the third lateral plate (14).

As a result of the above, the outdoor ducts (71, 73) are laid out side by side in the fourth lateral plate (15) of the casing (11) and the indoor ducts (72, 74) are laid out side by side in the third lateral plate (14) of the casing (11), thereby allowing each of the ducts (71, 72, . . . ) to be arranged straight towards the inside or the outside of the room.

Third Embodiment of the Invention

Figure 10:
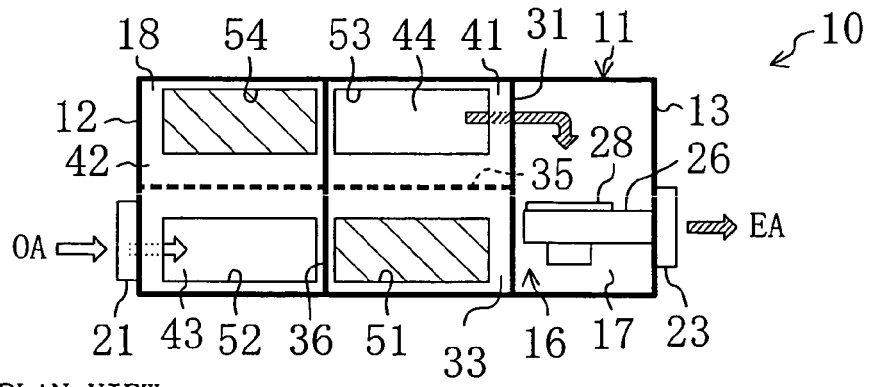
Figure 10:
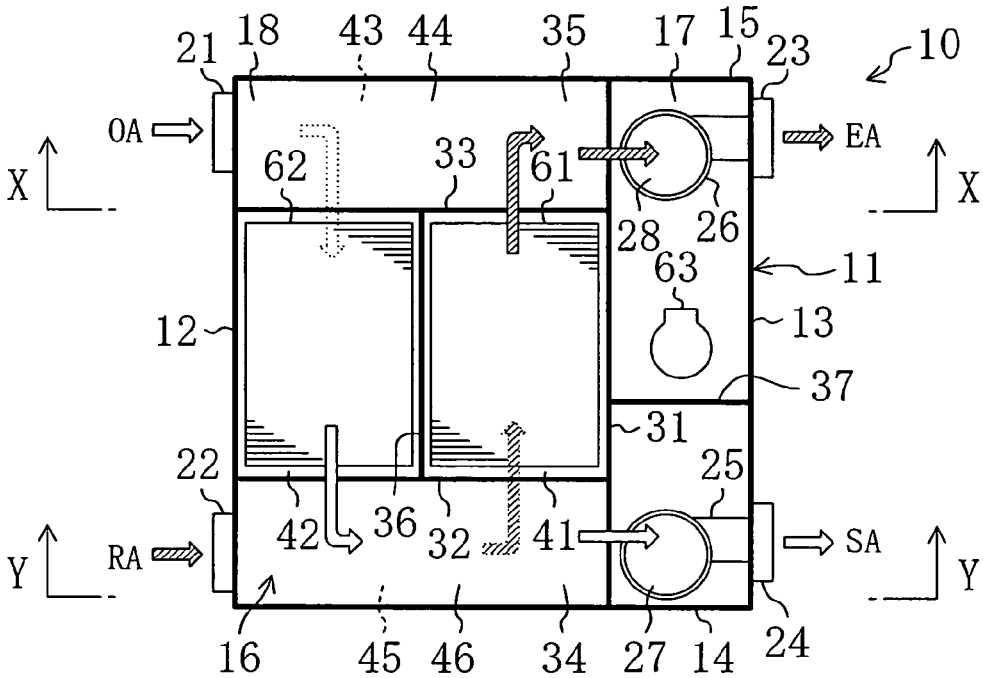
Figure 10:
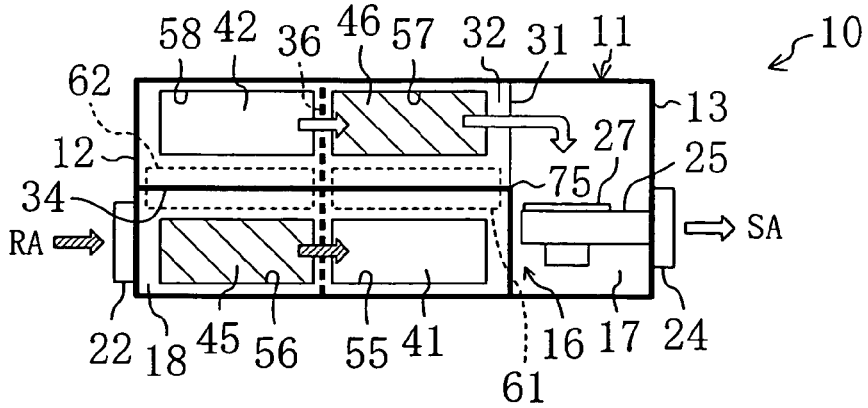

Referring now to FIG. 10, there is shown a third embodiment of the present invention. The third embodiment differs from the first embodiment, for example, in the placement of each of the air supplying fan (25) and the air exhausting fan (26).

The air supplying fan (25) and the air exhausting fan (26) are arranged such that their respective impeller axle centers are oriented in the thickness direction of the casing (11) (oriented upwardly in relation to FIG. 1).

In addition, in the casing (11), the positional relationship between the first inflow path (43) and the first outflow path (44) becomes "upside down" and, in addition, the positional relationship between the second inflow path (45) and the second outflow path (46) becomes "upside down". In conformity to this arrangement, the four openings (51, 52, 53, 54) of the third partition plate (33) and the four openings (55, 56, 57, 58) of the second partition plate (32) are provided "upside down".

Also in the humidity control system (10) of the present embodiment, its humidity control operation is the same as the humidity control operation of the first embodiment.

As a result of the above layout, the thickness of the casing (11) is restrained from increasing, thereby making the entire humidity control system (10) compact.

Furthermore, the inlet opening (28) of the air exhausting fan (26) is positioned such that it faces towards the second fan side communication opening (76) of the first partition plate (31) in fluid communication with the first outflow path (44) and, in addition, the inlet opening (27) of the air supplying fan (25) is positioned such that it faces towards the first fan side communication opening (75) of the first partition plate (31) in fluid communication with the second outflow path (46). This allows air in the first outflow path (44) to be smoothly drawn in from the inlet opening (28) of the air exhausting fan (26), and allows air in the second outflow path (46) to be smoothly drawn in from the inlet opening (27) of the air supplying fan (25).

Fourth Embodiment of the Present Invention

Figure 11:
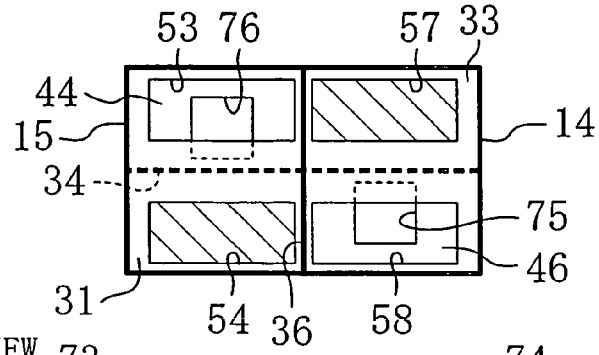
Figure 11:
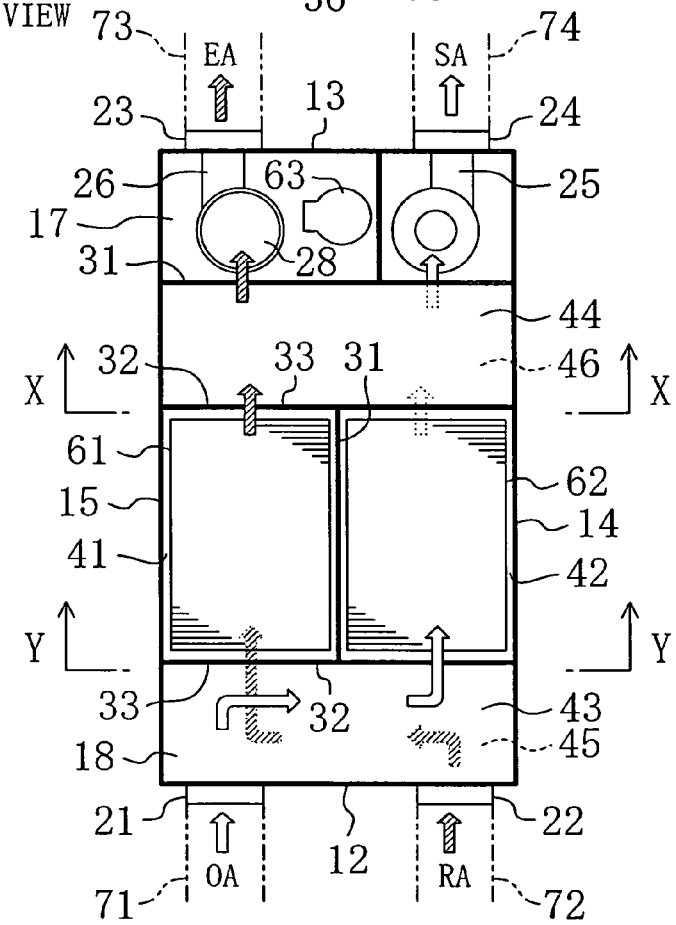
Figure 11:
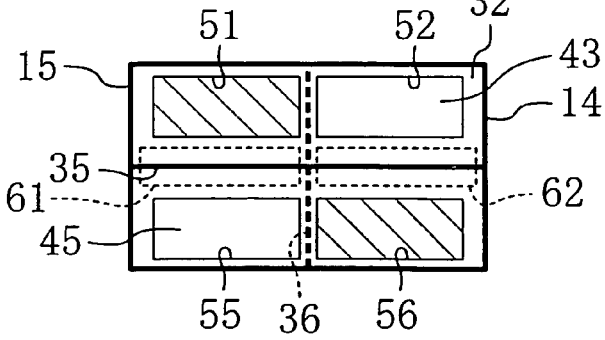

Referring now to FIG. 11, there is shown a fourth embodiment of the present invention. The fourth embodiment differs from the first embodiment in the layout of the equipment on the side of the second space (18).

More specifically, in the second space (18), the first heat exchange chamber (41) which houses therein the first heat exchanger (61) and the second heat exchange chamber (42) which houses therein the second heat exchanger (62) are adjacently formed so that they are arranged side by side in the longitudinal direction of the fan side lateral plate (13). In other words, the first heat exchange chamber (41) is defined on the left hand side of the second space (18) and the second heat exchange chamber (42) is defined on the right hand side of the second space (18).

In the second space (18), between one of continuous lateral surfaces of the two heat exchange chambers (41, 42) and the first lateral plate (12), the first and second inflow paths (43, 45) for the inflow of air are provided which extend along the first lateral plate (12) and which are arranged superimposedly in the thickness direction of the casing (11). In conformity to this arrangement, the second partition plate (32) is provided with four openings (51, 52, 55, 56).

In addition, in the second space (18), between the other continuous lateral surface of the two heat exchange chambers (41, 42) and the fan side lateral plate (13), the first and second outflow paths (44, 46) for the outflow of air are provided which extend along the fan side lateral plate (13) and which are arranged superimposedly in the thickness direction of the casing (11). In conformity to this arrangement, the third partition plate (33) is provided with four openings (53, 54, 57, 58).

The first outflow path (44) is brought into fluid communication with the first space (17) through the second fan side communication opening (76) and the second outflow path (46) is brought into fluid communication with the first space (17) through the first fan side communication opening (75).

Humidity Control Operation of the Humidity Control System

The humidity control operation of the present embodiment will be described only with respect to a first operation of the dehumidification mode. In regard to the other operations, it suffices if the four-way valve (64) and the dampers are switched in the same way that they are switched in the first embodiment, and their description is omitted accordingly.

In the first operation, the four-way valve (64) in the refrigerant circuit (60) is switched to a state as indicated in FIG. 3(A). When in the state of FIG. 3(A) the compressor (63) is brought into operation, the refrigerant is circulated in the refrigerant circuit (60) so that a first refrigeration cycle operation is performed in which the first heat exchanger (61) becomes a condenser and the second heat exchanger (62) becomes an evaporator.

More specifically, the refrigerant discharged from the compressor (63) dissipates heat and is condensed in the first heat exchanger (61). Subsequently, the refrigerant is delivered to the motor operated expansion valve (65) where it is reduced in pressure. The pressure reduced refrigerant absorbs heat and is evaporated in the second heat exchanger (62). Thereafter, the refrigerant is drawn into the compressor (63) where it is compressed. And the compressed refrigerant is again discharged from the compressor (63).

In addition, in the first operation, the second opening (52), the third opening (53), the fifth opening (55), and the eighth opening (58) are placed in the open state, while the first opening (51), the fourth opening (54), the sixth opening (56), and the seventh opening (57) are placed in the closed state, as shown in FIG. 11. And room air (RA) as a second air stream is supplied to the first heat exchanger (61) and outside air (OA) as a first air stream is supplied to the second heat exchanger (62).

More specifically, a second air stream as an inflow from the inside air inlet opening (22) is delivered, through the fifth opening (55), into the first heat exchange chamber (41) from the second inflow path (45). In the first heat exchange chamber (41), the second air stream is passed upward from below through the first heat exchanger (61). In the first heat exchanger (61), the adsorbent supported on the outer surface of the first heat exchanger (61) is heated by the refrigerant, and moisture is desorbed from the adsorbent. The moisture desorbed from the adsorbent is fed to the second air stream flowing through the first heat exchanger (61). The second air stream moisturized in the first heat exchanger (61) flows out to the first outflow path (44) from the first heat exchange chamber (41) through the third opening (53). Thereafter, the second air stream is drawn into the air exhausting fan (26) by way of the second fan side communication opening (76) and is discharged, through the exhaust air outlet opening (23), to outside the indoor space as exhaust air (EA).

On the other hand, a first air stream as an inflow from the outside air inlet opening (21) is delivered, through the second opening (52), into the second heat exchange chamber (42) from the first inflow path (43). In the second heat exchange chamber (42), the first air stream is passed downward from above through the second heat exchanger (62). In the second heat exchanger (62), moisture present in the first air stream is adsorbed by the adsorbent supported on the outer surface of the second heat exchanger (62). The resulting heat of adsorption is absorbed by the refrigerant. The first air stream dehumidified in the second heat exchanger (62) flows out to the second outflow path (46) from the second heat exchange chamber (42) through the eighth opening (58). Thereafter, the first air stream is drawn into the air supplying fan (25) by way of the first fan side communication opening (75) and is supplied through the supply air outlet opening (24) into the indoor space as supply air (SA).

Advantageous Effects of the Fourth Embodiment

In accordance with the humidity control system (10) of the present embodiment, the first and second inflow paths (43, 45) are provided along one continuous lateral surface of the first and second heat exchange chambers (41, 42) which are defined side by side in the longitudinal direction of the fan side lateral plate (13), while the first and second outflow paths (44, 46) are provided along the other continuous lateral surface of the first and second heat exchange chambers (41, 42), and, as a result of such arrangement, the humidity control system, i.e., the casing (11), has a shape which is elongated in a direction orthogonal to the fan side lateral plate (13).

In addition, the ducts (71, 72, . . . ) can be arranged in the longitudinal direction of the humidity control system (10); the installation space of the humidity control system (10) in the longitudinal direction of the fan side lateral plate (13) can be reduced; and for example the fourth lateral plate (15) orthogonal to the fan side lateral plate (13) can be positioned by a room wall.

Fifth Embodiment of the Invention

Figure 12:
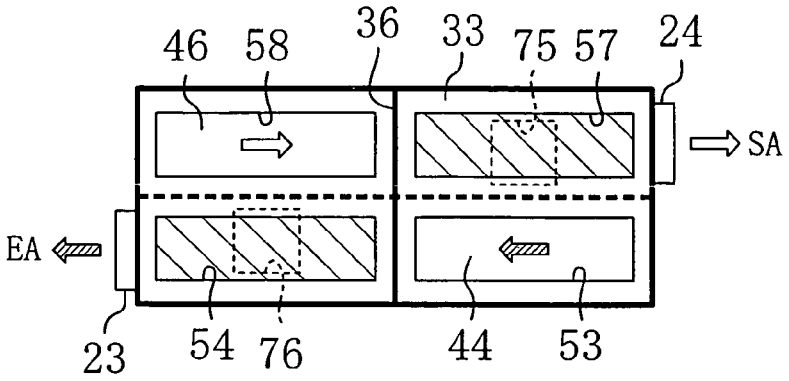
Figure 12:
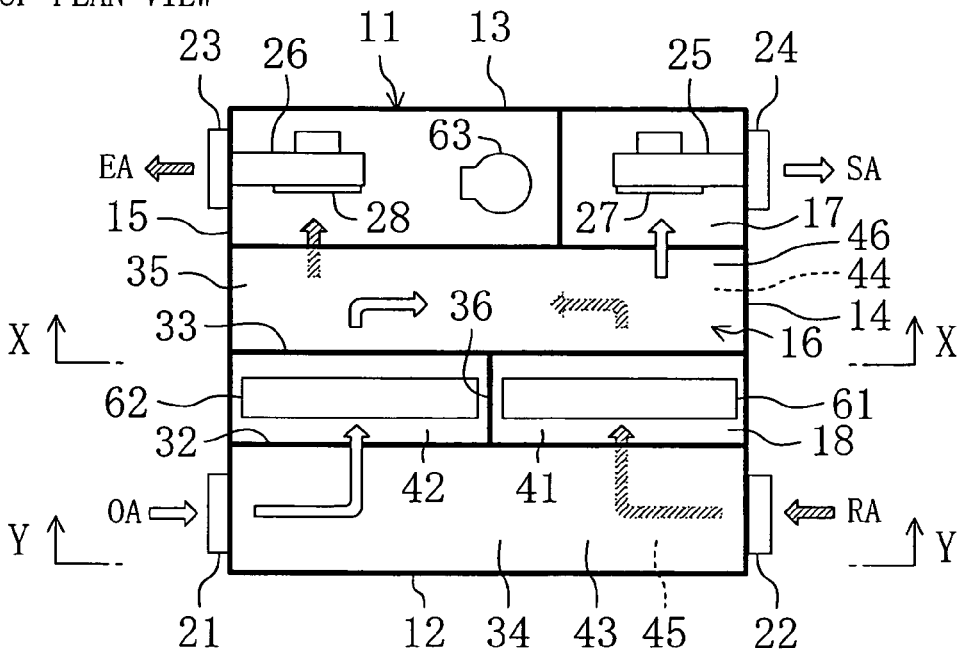
Figure 12:
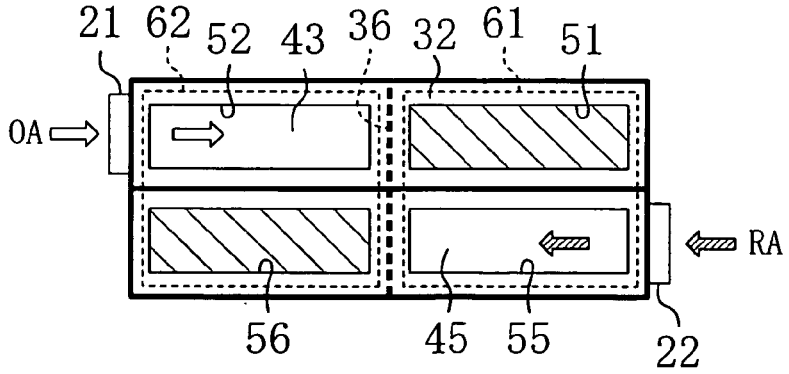

Referring now to FIG. 12, there is shown a fifth embodiment of the present invention. The fifth embodiment differs from the first embodiment, for example, in the placement of each of the first and second heat exchangers (61, 62).

To sum up, the first and second heat exchangers (61, 62) of the present embodiment are vertically arranged so that flow of air is allowed to travel in a direction perpendicular to the thickness direction of the casing (11).

In addition, in the second space (18), the first heat exchange chamber (41) which houses therein the first heat exchanger (61) and the second heat exchange chamber (42) which houses therein the second heat exchanger (62) are adjacently formed to each other so that they are arranged side by side in the longitudinal direction of the fan side lateral plate (13). In other words, the first heat exchange chamber (41) is defined on the right hand side of the second space (18), while the second heat exchange chamber (42) is defined on the left hand side of the second space (18).

And, between one continuous lateral surface of the two heat exchange chambers (41, 42) and the first lateral plate (12), the first and second inflow paths (43, 45) for the inflow of air are provided which extend along the first lateral plate (12) and which are arranged superimposedly in the thickness direction of the casing (11). In conformity to this arrangement, the second partition plate (32) is provided with four openings (51, 52, 55, 56).

In addition, between the other continuous lateral surface of the two heat exchange chambers (41, 42) and the fan side lateral plate (13), the first and second outflow paths (44, 46) for the outflow of air are provided which extend along the fan side lateral plate (13) and which are arranged superimposedly in the thickness direction of the casing (11). In conformity to this arrangement, the third partition plate (33) is provided with four openings (53, 54, 57, 58).

The first outflow path (44) is brought into fluid communication with the first space (17) through the second fan side communication opening (76) and the second outflow path (46) is brought into fluid communication with the first space (17) through the first fan side communication opening (75).

Humidity Control Operation of the Humidity Control System

The humidity control operation of the present embodiment will be described only with respect to a first operation of the dehumidification mode. In regard to the other operations, it suffices if the four-way valve (64) and the dampers are switched in the same way that they are switched in the first embodiment, and their description is omitted accordingly.

In the first operation, the four-way valve (64) in the refrigerant circuit (60) is switched to a state as indicated in FIG. 3(A). When in the state of FIG. 3(A) the compressor (63) is brought into operation, the refrigerant is circulated in the refrigerant circuit (60) so that a first refrigeration cycle operation is performed in which the first heat exchanger (61) becomes a condenser and the second heat exchanger (62) becomes an evaporator.

More specifically, the refrigerant discharged from the compressor (63) dissipates heat and is condensed in the first heat exchanger (61). Subsequently, the refrigerant is delivered to the motor operated expansion valve (65) where it is reduced in pressure. The pressure reduced refrigerant absorbs heat and is evaporated in the second heat exchanger (62). Thereafter, the refrigerant is drawn into the compressor (63) where it is compressed. And the compressed refrigerant is again discharged from the compressor (63).

In addition, in the first operation, the second opening (52), the third opening (53), the fifth opening (55), and the eighth opening (58) are placed in the open state, while the first opening (51), the fourth opening (54), the sixth opening (56), and the seventh opening (57) are placed in the closed state. And, as shown in FIG. 12, room air (RA) as a second air stream is supplied to the first heat exchanger (61) and outside air (OA) as a first air stream is supplied to the second heat exchanger (62).

More specifically, a second air stream as an inflow from the inside air inlet opening (22) is delivered, through the fifth opening (55), into the first heat exchange chamber (41) from the second inflow path (45). In the first heat exchange chamber (41), the second air stream passes through the first heat exchanger (61) in the direction from the second partition plate (32) towards the third partition plate (33). In the first heat exchanger (61), the adsorbent supported on the outer surface of the first heat exchanger (61) is heated by the refrigerant, and moisture is desorbed from the adsorbent. The moisture desorbed from the adsorbent is fed to the second air stream passing through the first heat exchanger (61). The second air stream moisturized in the first heat exchanger (61) flows out to the first outflow path (44) from the first heat exchange chamber (41) through the third opening (53). Thereafter, the second air stream is drawn into the air exhausting fan (26) by way of the second fan side communication opening (76) and is discharged, through the exhaust air outlet opening (23), to outside the indoor space as exhaust air (EA).

On the other hand, a first air stream as an inflow from the outside air inlet opening (21) is delivered, through the second opening (52), into the second heat exchange chamber (42) from the first inflow path (43). In the second heat exchange chamber (42), the first air stream passes through the second heat exchanger (62) in the direction from the second partition plate (32) towards the third partition plate (33). In the second heat exchanger (62), moisture present in the first air stream is adsorbed by the adsorbent supported on the outer surface of the second heat exchanger (62). The resulting heat of adsorption is absorbed by the refrigerant. The first air stream dehumidified in the second heat exchanger (62) flows out to the second outflow path (46) from the second heat exchange chamber (42) through the eighth opening (58). Thereafter, the first air stream is drawn into the air supplying fan (25) by way of the first fan side communication opening (75) and is supplied through the supply air outlet opening (24) into the indoor space as supply air (SA).

In accordance with the humidity control system (10) of the present embodiment, its depthwise width in FIG. 12 can be reduced.

Sixth Embodiment of the Invention

Figure 13:
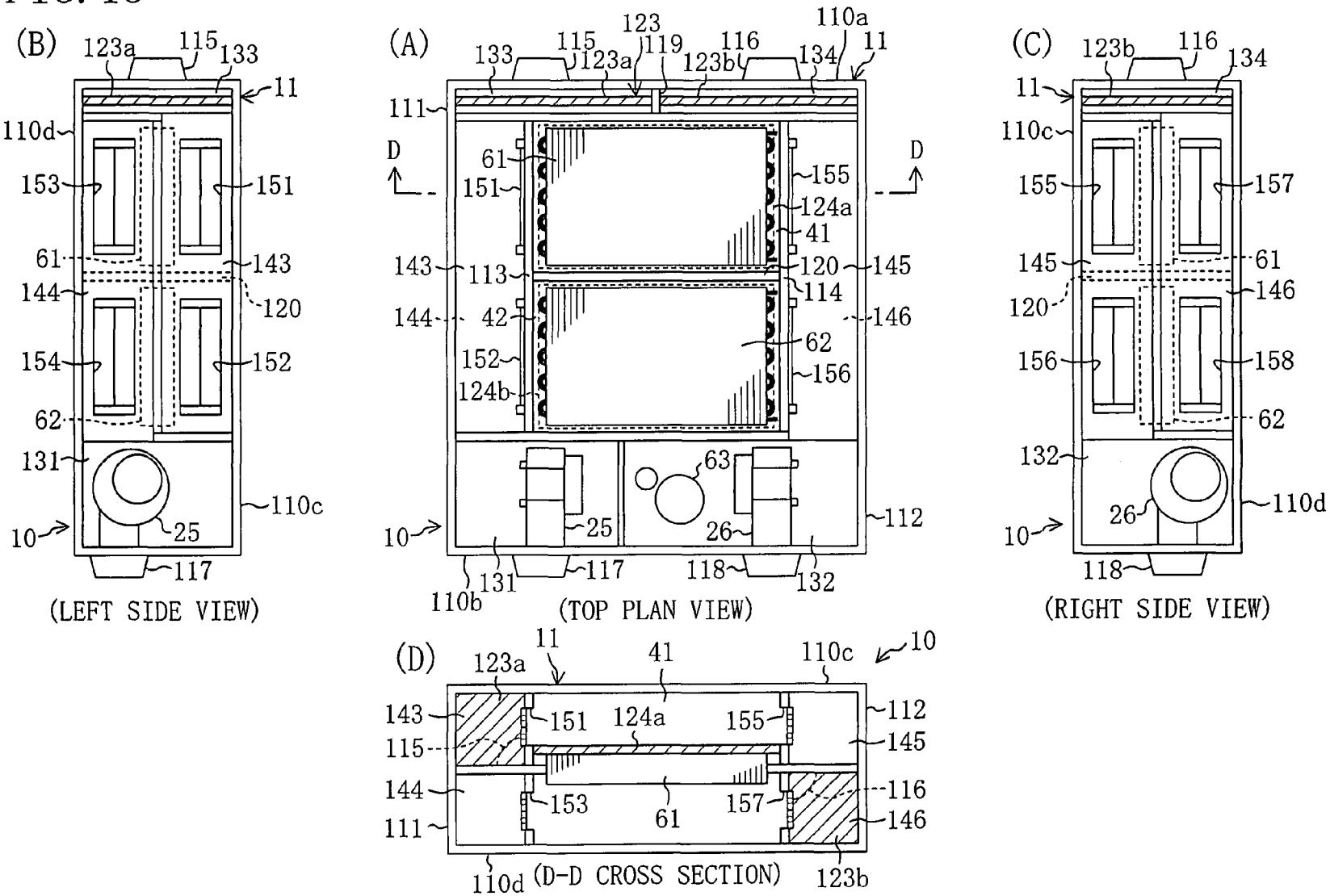

With reference to FIG. 13, there is shown a sixth embodiment of the present invention. The description of the present embodiment contains the following positional terms: "upper", "lower", "right", "left", "front", "rear", "near side", and "far side" are those when viewed from the front side of the humidity control system (10), unless otherwise specified. In addition, the front of the humidity control system (10) is a lower lateral surface in FIG. 13(A).

The humidity control system (10) of the present embodiment is provided with a somewhat flattened, rectangular box-shaped casing (11). In the inside of the casing (11), there is formed an air passageway for establishing fluid communication between an indoor space and an outdoor space.

The casing (11) accommodates therein a refrigerant circuit (60). The refrigerant circuit (60) is a circuit in which a first heat exchanger (61) and a second heat exchanger (62) are fluidly connected, and is constructed in the same way that the corresponding one in the first embodiment is constructed. In addition, the first and second heat exchangers (61, 62) of the present embodiment are identical in construction with their counterparts in the first embodiment. The description with respect to the structure of the refrigerant circuit (60) and the structure of the first and second heat exchangers (61, 62) is omitted here.

In the casing (11), a rear surface panel (110*a*) is provided on the farmost side, while a front surface panel (110*b*) is provided on the nearest side. In addition, in the casing (11), a first lateral plate (111) is provided on the left hand side, while a second lateral plate (112) is provided on the right hand side. Furthermore, in the casing (11), a top plate (110*c*) is provided on the upper side, while a bottom plate (110*d*) is provided on the lower side.

A first inlet opening (115), through which outside air (OA) from the outdoor space is drawn in, is formed in the rear surface panel (110*a*) on the left hand side thereof, while a second inlet opening (116), through which room air (RA) from the indoor space is drawn in, is formed in the rear surface panel (110*a*) on the right hand side thereof. On the other hand, an air supplying opening (117), through which humidity controlled air (SA) is supplied into the indoor space, is formed in the front surface panel (110*b*) on the left hand side thereof, while an air exhausting opening (118), through which exhaust air (OA) is discharged to the outdoor space, is formed in the front surface panel (110*b*) on the right hand side thereof.

The interior of the casing (11) is divided into roughly three spaces in the front and rear direction. Of these three spaces, one defined on the side of the front surface panel (110*b*) of the casing (11) is divided into two spaces, i.e., right and left spaces, of which the latter constitutes an air supplying side passageway (131) and of which the former constitutes an air exhausting side passageway (132).

The air supplying side passageway (131) is in fluid communication with the indoor space through the air supplying opening (117). The air supplying fan (25) is disposed in the air supplying side passageway (131). On the other hand, the air exhausting side passageway (132) is in fluid communication with the outdoor space through the air exhausting opening (118). The air exhausting fan (26) is disposed in the air exhausting side passageway (132). In addition, the compressor (63) is disposed on the left hand side of the air exhausting side passageway (132).

The space defined on the side of the rear surface panel (110*a*) of the casing (11) is divided by an inlet side partition plate (119) into two spaces, i.e., right and left spaces, of which the latter constitutes a first inlet passageway (133) and of which the former constitutes a second inlet passageway (134) as a room air supplying passageway. And the first inlet passageway (133) is in fluid communication with the outdoor space through the first inlet opening (115), while the second inlet passageway (134) is in fluid communication with the indoor space through the second inlet opening (116).

In addition, in the space defined on the side of the rear surface panel (110*a*) of the casing (11), an inlet side filter (123) is disposed which is passed completely through the inlet side partition plate (119) and which is arranged so as to extend over both the first inlet passageway (133) and the second inlet passageway (134). The inlet side filter (123) is an integral configuration made up of a first pre-filter (123*a*) positioned in the first inlet passageway (133) and a second pre-filter (123*b*) positioned in the second inlet passageway (134). And the first pre-filter (123*a*) traps dust particles present in outside air (OA) drawn from the first inlet opening (115), while the second pre-filter (123*b*) traps dust particles present in room air (RA) drawn from the second inlet opening (116). The second pre-filter (123*b*) constitutes an indoor filter.

The space defined centrally in the front and rear direction of the casing (11) is horizontally divided by the first partition plate (113) positioned on the left hand side and the second partition plate (114) positioned on the right hand side into three spaces. Furthermore, the space defined between the first partition plate (113) and the second partition plate (114) is divided by a central partition plate (120) into a first heat exchange chamber (41) which is a first passageway and a second heat exchange chamber (42) which is a second passageway.

The first heat exchange chamber (41) is formed behind the central partition plate (120) and accommodates therein the first heat exchanger (61). The first heat exchanger (61), as shown in FIG. 13(D), is arranged vertically centrally in the first heat exchange chamber (41). The first heat exchange chamber (41) is divided by the first heat exchanger (61) into an upper space and a lower space. In addition, the first heat exchanger (61) is formed into a flattened rectangular shape, and has an upper surface and a lower surface each of which has a larger area than the other surfaces in the first heat exchange chamber (41). Furthermore, in the first heat exchanger (61), air to be treated is vertically distributed, thereby forming a distribution space for controlling the level of humidity of the air to be treated. And an inflow surface into which outside air (OA) flows is formed in the upper side of the first heat exchanger (61).

In the upper side of the first heat exchanger (61), a first filter (124*a*) is arranged and formed along the outside air (OA) inflow surface. The first filter (124*a*) constitutes a first filter part and is arranged so as to cover the entire area of the upper side of the first heat exchanger (61). The first filter (124*a*) catches dust particles present in outside air (OA) flowing into the first heat exchanger (61).

The second heat exchange chamber (42) is formed on the front side of the central partition plate (120) and accommodates therein the second heat exchanger (62). Like the first heat exchanger (61), the second heat exchanger (62) is arranged vertically centrally in the second heat exchange chamber (42). The second heat exchange chamber (42) is divided by the second heat exchanger (62) into an upper space and a lower space. In addition, like the first heat exchanger (61), in the second heat exchanger (62), air to be treated is vertically distributed, thereby forming a distribution space for controlling the level of humidity of the air to be treated. And an inflow surface into which outside air (OA) flows is formed in the upper side of the second heat exchanger (62).

In the upper side of the second heat exchanger (62), a second filter (124*b*) is arranged and formed along the outside air (OA) inflow surface. The second filter (124*b*) is arranged so as to cover the entire area of the upper side of the second heat exchanger (62) and constitutes a second filter part. The second filter (124*b*) catches dust particles present in outside air flowing into the second heat exchanger (62).

The space defined between the first lateral plate (111) and the first partition plate (113) is divided into an upper space and a lower space. The upper space constitutes a left hand side upper passageway (143), while the lower space constitutes a left hand side lower passageway (144). The left hand side upper passageway (143) is in fluid communication with the first inlet passageway (133) and is partitioned from the air supplying side passageway (131). The left hand side lower passageway (144) is in fluid communication with the air supplying side passageway (131) and is partitioned from the first inlet passageway (133).

The space defined between the second lateral plate (112) and the second partition plate (114) is divided into an upper space and a lower space. The upper space constitutes a right hand side upper passageway (145), while the lower space constitutes a right hand side lower passageway (146). The right hand side upper passageway (145) is in fluid communication with the air exhausting side passageway (132) and is partitioned from the second inlet passageway (134). The right hand side lower passageway (146) is in fluid communication with the second inlet passageway (134) and is partitioned from the air exhausting side passageway (132).

In addition, the first partition plate (113) is provided with a first upper left opening (151), a second upper left opening (152), a first lower left opening (153), and a second lower left opening (154). The first upper left opening (151) is formed in a far side upper portion of the first partition plate (113) and the second upper left opening (152) is formed in a near side upper portion of the first partition plate (113). In addition, the first lower left opening (153) is formed in a far side lower portion of the first partition plate (113) and the second lower left opening (154) is formed in a near side lower portion of the first partition plate (113).

Each of the first to fourth openings (151, 152, . . . ) is provided with a respective opening/closing damper. Each of the opening/closing dampers of the openings (151, 152, . . . ) is able to selectively switch its state between the open state and the closed state independently of the other. When the first upper left opening (151) enters the open state, the left hand side upper passageway (143) and the upper space of the first heat exchange chamber (41) are brought into fluid communication with each other. In addition, when the second upper left opening (152) enters the open state, the left hand side upper passageway (143) and the upper space of the second heat exchange chamber (42) are brought into fluid communication with each other. Furthermore, when the first lower left opening (153) enters the open state, the left hand side lower passageway (144) and the lower space of the first heat exchange chamber (41) are brought into fluid communication with each other. In addition, when the second lower left opening (154) enters the open state, the left hand side lower passageway (144) and the lower space of the second heat exchange chamber (42) are brought into fluid communication with each other.

On the other hand, the second partition plate (114) is provided with a first upper right opening (155), a second upper right opening (156), a first lower right opening (157), and a second lower right opening (158). The first upper right opening (155) is formed in a far side upper portion of the second partition plate (114) and the second upper right opening (156) is formed in a near side upper portion of the second partition plate (114). In addition, the first lower right opening (157) is formed in a far side lower portion of the second partition plate (114) and the second lower right opening (158) is formed in a near side lower portion of the second partition plate (114).

Each of the fifth to eighth openings (155, 156, . . . ) is provided with a respective opening/closing damper (155*a*, 156*a*, 157*a*, 158*a*). Each of the opening/closing dampers of the openings (155, 156, . . . ) is able to selectively switch its state between the open state and the closed state independently of the other. When the first upper right opening (155) enters the open state, the right hand side upper passageway (145) and the upper space of the first heat exchange chamber (41) are brought into fluid communication with each other. In addition, when the second upper right opening (156) enters the open state, the right hand side upper passageway (145) and the upper space of the second heat exchange chamber (42) are brought into fluid communication with each other. Furthermore, when the first lower right opening (157) enters the open state, the right hand side lower passageway (146) and the lower space of the first heat exchange chamber (41) are brought into fluid communication with each other. In addition, when the second lower right opening (158) enters the open state, the right hand side lower passageway (146) and the lower space of the second heat exchange chamber (42) are brought into fluid communication with each other.

The humidity control system (10) having the above configuration is configured such that it alternately performs a first operation and a second operation by changing the circulation direction of refrigerant in the refrigerant circuit (60) and by changing the opening/closing state of each of the dampers (151*a*, 152*a*, 153*a*, 154*a*) of the first to eighth openings (151, 152, . . . ).

More specifically, the humidity control system (10) is configured such that it is operable to switch its operation between a first operation in which outside air (OA) is sequentially distributed first through the first filter (124*a*) and next through the first heat exchanger (61) and is supplied to the indoor space while simultaneously room air (RA) is sequentially distributed first through the second heat exchanger (62) and next through the second filter (124*b*) and is discharged to the outdoor space, and a second operation in which outside air (OA) is sequentially distributed first through the second filter (124*b*) and next through the second heat exchanger (62) and is supplied to the indoor space while simultaneously room air (RA) is sequentially distributed first through the first heat exchanger (61) and next through the first filter (124*a*) and is discharged to the outdoor space.

Running Operation

The running operation of the humidity control system (10) is described. The humidity control system (10) is so configured as to continuously perform either a dehumidification mode of operation or a humidification mode of operation while making alternate switching between a first operation and a second operation by changing the circulation direction of refrigerant in the refrigerant circuit (60).

Dehumidification Mode

In a first operation of the dehumidification mode, the four-way valve (64) is set to a second state as shown in FIG. 3(B). In the refrigerant circuit (60), the first heat exchanger (61) functions as an evaporator while on the other hand the second heat exchanger (62) functions as a condenser. On the other hand, in a second operation of the dehumidification mode, the four-way valve (64) is set to a first state as shown in FIG. 3(A). In the refrigerant circuit (60), the first heat exchanger (61) functions as a condenser while on the other hand the second heat exchanger (62) functions as an evaporator.

Figure 14:
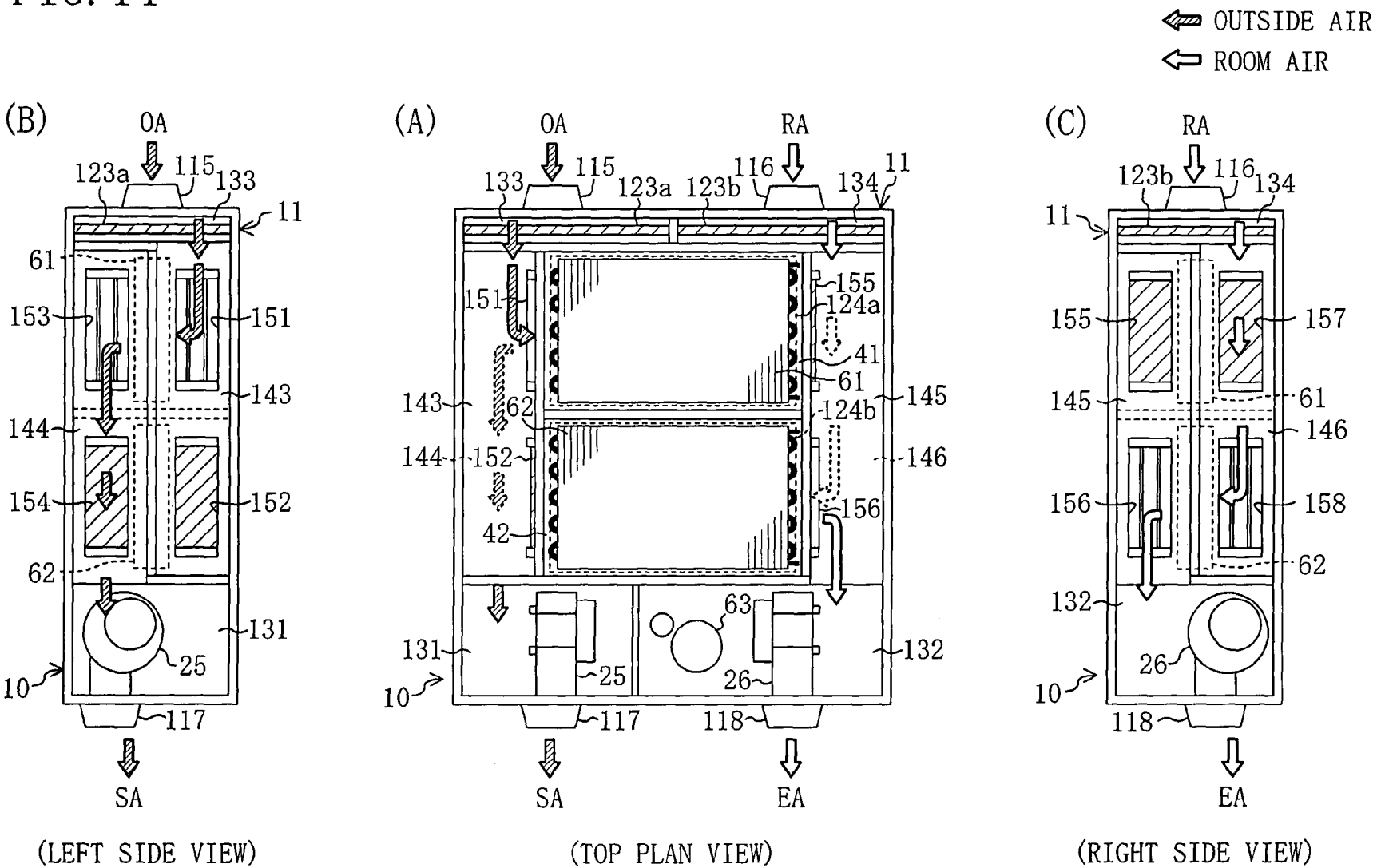

As shown in FIG. 14, when the air supplying fan (25) and the air exhausting fan (26) are brought into operation, outside air (OA) is drawn into the casing (11) through the first inlet opening (115) and then flows into the first inlet passageway (133), while room air (RA) is drawn into the casing (11) from the second inlet opening (116) and then flows into the second inlet passageway (134).

The outside air (OA) which has entered the first inlet passageway (133) is passed through the first pre-filter (123*a*). Dust particles of relatively large size present in the outside air (OA) are trapped by the first pre-filter (123*a*). Thereafter, the outside air (OA) flows into the left hand side upper passageway (143). Meanwhile, the room air (RA) which has entered the second inlet passageway (134) is passed through the second pre-filter (123*b*). Dust particles present in the room air (RA) are trapped by the second pre-filter (123*b*). Thereafter, the room air (RA) flows into the right hand side lower passageway (146).

Figure 15:
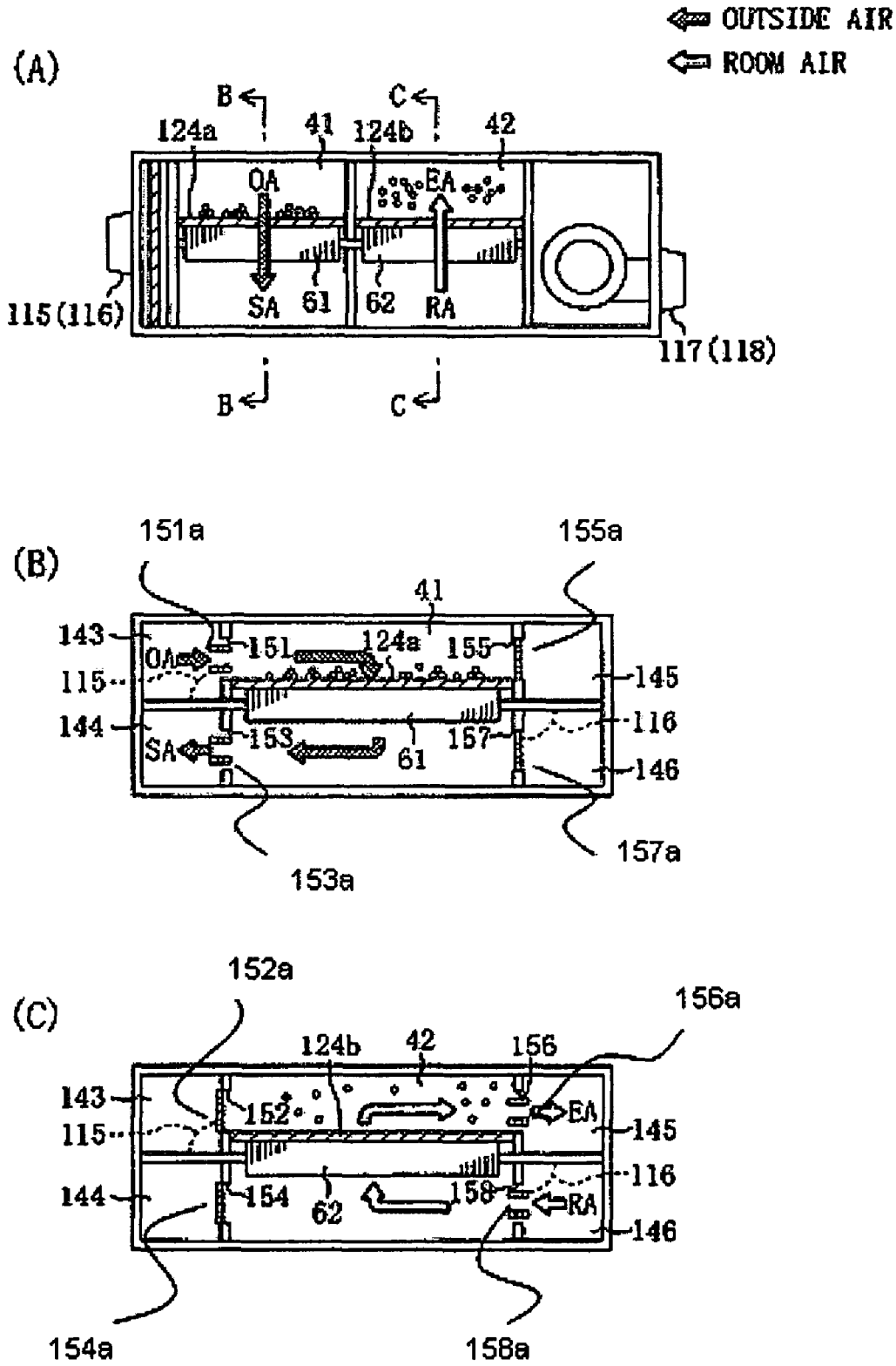

Hereinafter, the first operation of the dehumidification mode is described by making reference to FIGS. 14 and 15. FIG. 15(A) is a cross section view which illustrates the inside of the first heat exchange chamber (41) and the inside of the second heat exchange chamber (42), when viewed from the left hand side. FIG. 15(B) is a cross section view taken along line B-B of FIG. 15(A). FIG. 15(C) is a cross section view taken along line C-C of FIG. 15(A).

In the first operation of the dehumidification mode, the opening/closing dampers of the first upper left opening (151), the first lower left opening (153), the second upper right opening (156), and the second lower right opening (158) are placed in the open state, while the opening/closing dampers of the second upper left opening (152), the second lower left opening (154), the first upper right opening (155), and the first lower right opening (157) are placed in the closed state.

Accordingly, outside air (OA) being distributed through the left hand side upper passageway (143) enters the upper space of the first heat exchange chamber (41) from the first upper left opening (151). This air is distributed in a direction from the upper to the lower side of the first filter (124*a*), during which airborne dust particles are trapped at the upper side of the first filter (124*a*). Thereafter, the air is passed through the inflow space of the first heat exchanger (61) and flows into the lower space of the first heat exchange chamber (41). Moisture present in the air is adsorbed by the adsorbent of the first heat exchanger (61) functioning as an evaporator. The resulting heat of adsorption is absorbed by the refrigerant in the first heat exchanger (61).

The air, from which dust was removed by the first filter (124*a*) and which was dehumidified by the first heat exchanger (61) as described above, flows into the left hand side lower passageway (144) from the first lower left opening (153). Then, the air is distributed through the air supplying side passageway (131) and is supplied through the air supplying opening (117) into the indoor space as humidity controlled air (SA).

On the other hand, room air (RA) being distributed through the right hand side lower passageway (146) enters the lower space of the second heat exchange chamber (42) from the second lower right opening (158). This air flows upward and is distributed through the inflow space of the second heat exchanger (62). In the second heat exchanger (62) functioning as a condenser, the adsorbent of the second heat exchanger (62) is heated by the refrigerant and moisture is desorbed from the adsorbent. In the second heat exchanger (62), the moisture desorbed from the adsorbent is fed to the air and the adsorbent is regenerated.

The air after passage through the second heat exchanger (62) is distributed in a direction from the lower to the upper side of the second filter (124*b*). At this time, dust particles, trapped at the upper side of the second filter (124*b*) in the after-mentioned second operation of the dehumidification mode, are blown away therefrom by air flowing upwardly through the second filter (124*b*). In this way, removal of the dust trapped at the upper side of the second filter (124*b*) is accomplished. Then, the dust is pressure-fed to outside the second heat exchange chamber (42) by air which has passed through the second filter (124*b*).

The air, which was used to regenerate the adsorbent of the second heat exchanger (62) and which is containing dust particles removed from the second filter (124*b*) as described above, flows into the right hand side upper passageway (145) from the second upper right opening (156). Then, the air is distributed through the air exhausting side passageway (132) and is discharged, as exhaust air (EA), to the outdoor space from the air exhausting opening (118).

Figure 16:
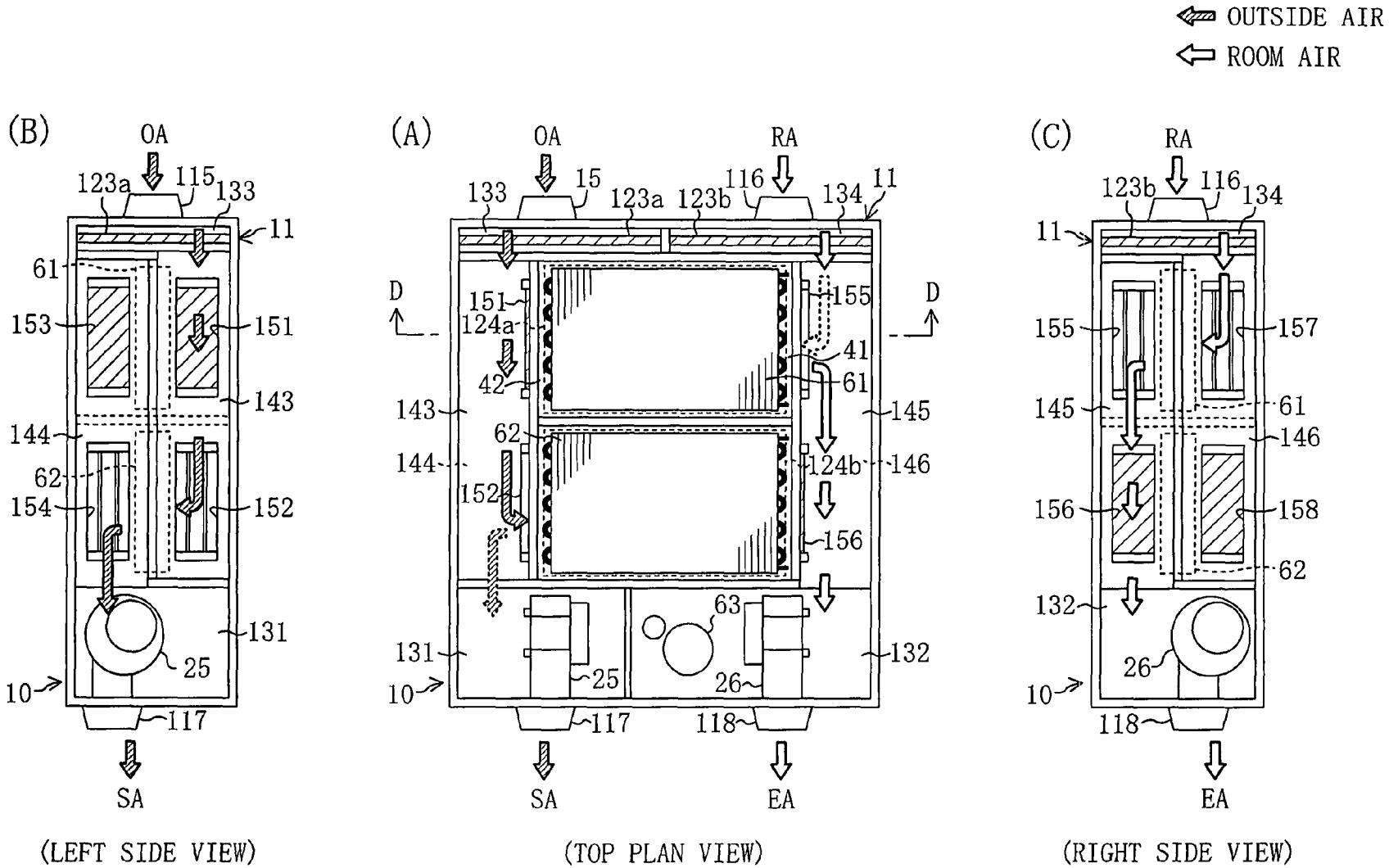
Figure 17:
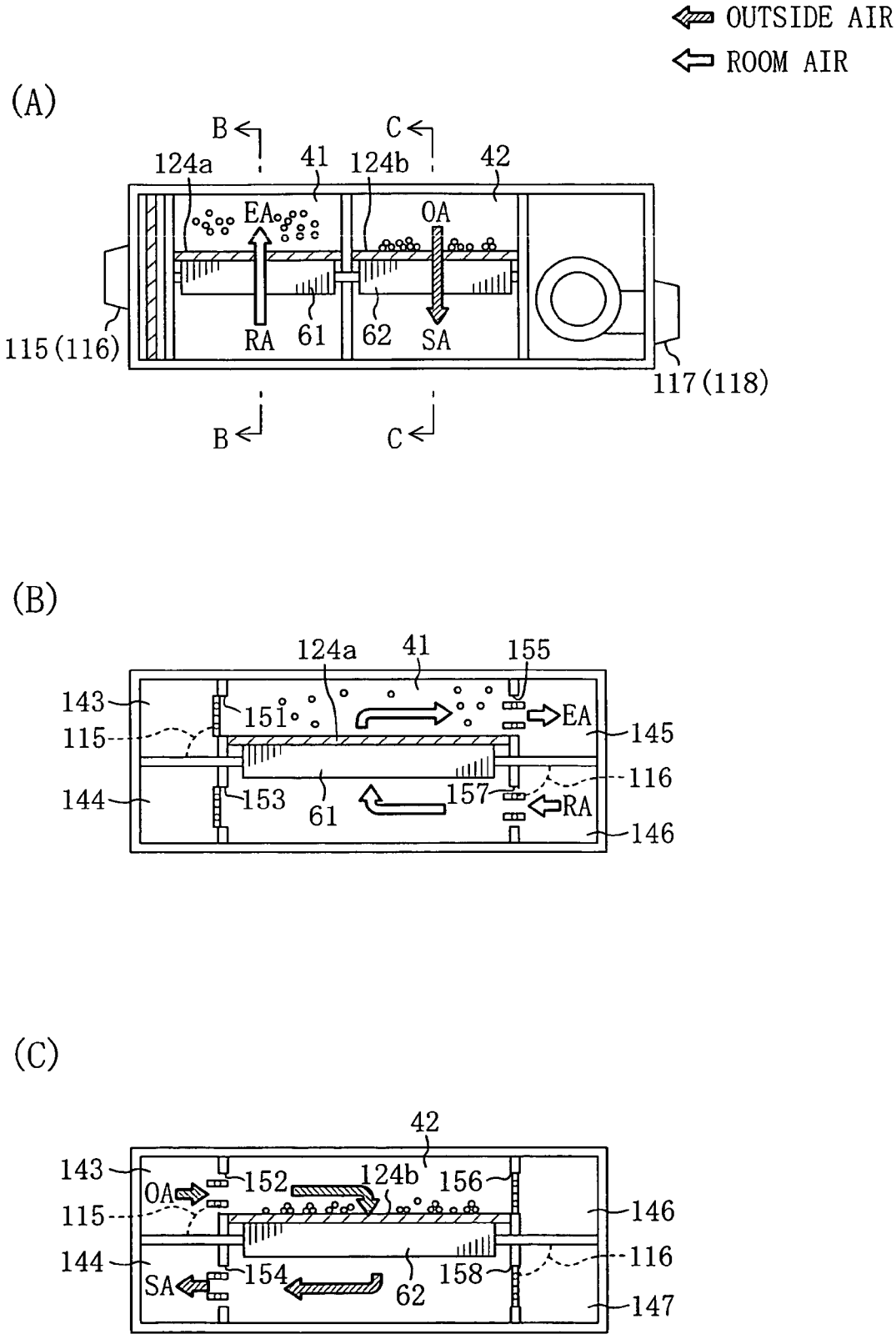

Next, the second operation of the dehumidification mode is described by making reference to FIGS. 16 and 17. FIG. 17(A) is a cross section view which illustrates the inside of the first heat exchange chamber (41) and the inside of the second heat exchange chamber (42), when viewed from the left hand side. FIG. 17(B) is a cross section view taken along line B-B of FIG. 17(A). FIG. 17(C) is a cross section view taken along line C-C of FIG. 17(A).

In the second operation of the dehumidification mode, the opening/closing dampers of the second upper left opening (152), the second lower left opening (154), the first upper right opening (155), and the first lower right opening (157) are placed in the open state, while the opening/closing dampers of the first upper left opening (151), the first lower left opening (153), the second upper right opening (156), and the second lower right opening (158) are placed in the closed state.

Accordingly, outside air (OA) being distributed through the left hand side upper passageway (143) enters the upper space of the second heat exchange chamber (42) from the second upper left opening (152). This air is distributed in a direction from the upper to the lower side of the second filter (124*b*), during which airborne dust particles are trapped at the upper side of the second filter (124*b*). Thereafter, the air is passed through the inflow space of the second heat exchanger (62) and flows into the lower space of the second heat exchange chamber (42). Moisture present in the air is adsorbed by the adsorbent of the second heat exchanger (62) functioning as an evaporator. The resulting heat of adsorption is absorbed by the refrigerant in the second heat exchanger (62).

The air, from which dust was removed by the second filter (124*b*) and which was dehumidified by the second heat exchanger (62) as described above, flows into the left hand side lower passageway (144) from the second lower left opening (154). Then, the air is distributed through the air supplying side passageway (131) and is supplied through the air supplying opening (117) into the indoor space as humidity controlled air (SA).

On the other hand, room air (RA) being distributed through the right hand side lower passageway (146) enters the lower space of the first heat exchange chamber (41) from the first lower right opening (157). Then, this air flows upwardly and is distributed through the inflow space of the first heat exchanger (61). In the first heat exchanger (61) functioning as a condenser, the adsorbent of the first heat exchanger (61) is heated by the refrigerant and moisture is desorbed from the adsorbent. In the first heat exchanger (61), the moisture desorbed from the adsorbent is fed to the air and the adsorbent is regenerated.

The air after passage through the first heat exchanger (61) is distributed in a direction from the lower to the upper side of the first filter (124*a*). At this time, dust particles, trapped at the upper side of the first filter (124*a*) in the aforesaid first operation, are blown away therefrom by air flowing upwardly through the first filter (124*a*). In this way, removal of the dust trapped at the upper side of the first filter (124*a*) is accomplished. Then, the dust is pressure-fed to outside the first heat exchange chamber (41) by air which has passed through the first filter (124*a*).

The air, which was used for regeneration of the adsorbent of the first heat exchanger (61) and which is carrying the dust removed from the first filter (124*a*) as described above, flows into the right hand side upper passageway (145) from the first upper right opening (155). Then, the air is distributed through the air exhausting side passageway (132) and is discharged, as exhaust air (EA), to the outdoor space from the air exhausting opening (118).

Humidification Mode

In a first operation of the humidification mode, the four-way valve (64) is set to a first state as shown in FIG. 3(A). In the refrigerant circuit (60), the first heat exchanger (61) functions as a condenser while on the other hand the second heat exchanger (62) functions as an evaporator. On the other hand, in a second operation of the humidification mode, the four-way valve (64) is set to a second state as shown in FIG. 3(B). In the refrigerant circuit (60), the first heat exchanger (61) functions as an evaporator while on the other hand the second heat exchanger (62) functions as a condenser.

As shown in FIG. 14, when the air supplying fan (25) and the air exhausting fan (26) are brought into operation, outside air (OA) is drawn into the casing (11) from the first inlet opening (115) and then flows into the first inlet passageway (133) while room air (RA) is drawn into the casing (11) from the second inlet opening (116) and then flows into the second inlet passageway (134).

The outside air (OA) which has entered the first inlet passageway (133) is passed through the first pre-filter (123*a*). Dust particles of relatively large size present in the outside air (OA) are trapped by the first pre-filter (123*a*). Thereafter, the outside air (OA) flows into the left hand side upper passageway (143). On the other hand, the room air (RA) which has entered the second inlet passageway (134) is passed through the second pre-filter (123*b*). Dust particles present in the room air (RA) are trapped by the second pre-filter (123*b*). Thereafter, the room air (RA) flows into the right hand side lower passageway (146).

In the following, the description will be made with respect to the first operation of the humidification mode with reference to FIGS. 14 and 15. In the first operation of the humidification mode, the opening/closing dampers of the first upper left opening (151), the first lower left opening (153), the second upper right opening (156), and the second lower right opening (158) are placed in the open state, while the opening/closing dampers of the second upper left opening (152), the second lower left opening (154), the first upper right opening (155), and the first lower right opening (157) are placed in the closed state.

Accordingly, outside air (OA) being distributed through the left hand side upper passageway (143) enters the upper space of the first heat exchange chamber (41) from the first upper left opening (151). This air is distributed in a direction from the upper to the lower side of the first filter (124*a*), during which airborne dust particles are trapped at the upper side of the first filter (124*a*). Thereafter, the air is passed through the inflow space of the first heat exchanger (61) and then flows into the lower space of the first heat exchange chamber (41). In the first heat exchanger (61) functioning as a condenser, the adsorbent of the first heat exchanger (61) is heated by the refrigerant and moisture is desorbed from the adsorbent. The desorbed moisture is fed to the air.

The air, from which dust was removed by the first filter (124*a*) and which was humidified in the first heat exchanger (61) as described above, flows into the left hand side lower passageway (144) from the first lower left opening (153). Then, the air is distributed through the air supplying side passageway (131) and is supplied through the air supplying opening (117) into the indoor space as humidity controlled air (SA).

On the other hand, room air (RA) being distributed through the right hand side lower passageway (146) enters the lower space of the second heat exchange chamber (42) from the second lower right opening (158). Then, this air flows upwardly and is distributed through the inflow space of the second heat exchanger (62). Moisture present in the air is adsorbed by the adsorbent of the second heat exchanger (62) functioning as an evaporator. The resulting heat of adsorption is absorbed by the refrigerant in the second heat exchanger (62).

The air after passage through the second heat exchanger (62) is distributed in a direction from the lower to the upper side of the second filter (124*b*). At this time, dust particles, trapped at the upper side of the second filter (124*b*) in the after-mentioned second operation, are blown away therefrom by air flowing upwardly through the second filter (124*b*). In this way, removal of the dust trapped at the upper side of the second filter (124*b*) is accomplished. Then, the dust is pressure-fed to outside the second heat exchange chamber (42) by air which has passed through the second filter (124*b*).

The air, which gave moisture to the adsorbent of the second heat exchanger (62) and which is containing dust particles removed from the second filter (124*b*) as described above, flows into the right hand side upper passageway (145) from the second upper right opening (156). Then, this air is distributed through the air exhausting side passageway (132) and is discharged, as exhaust air (EA), to the outdoor space from the air exhausting opening (118).

Next, the description will be made with respect to the second operation of the humidification mode by making reference to FIGS. 16 and 17. In the second operation of the humidification mode, the opening/closing dampers of the second upper left opening (152), the second lower left opening (154), the first upper right opening (155), and the first lower right opening (157) are placed in the open state, while the opening/closing dampers of the first upper left opening (151), the first lower left opening (153), the second upper right opening (156), and the second lower right opening (158) are placed in the closed state.

Accordingly, outside air (OA) being distributed through the left hand side upper passageway (143) enters the upper space of the second heat exchange chamber (42) from the second upper left opening (152). This air is distributed in a direction from the upper to the lower side of the second filter (124*b*), during which airborne dust particles are trapped at the upper side of the second filter (124*b*). Thereafter, the air is passed through the inflow space of the second heat exchanger (62) and then flows into the lower space of the second heat exchange chamber (42). In the second heat exchanger (62) functioning as a condenser, the adsorbent of the second heat exchanger (62) is heated by the refrigerant and moisture is desorbed from the adsorbent. The desorbed moisture is fed to the air.

The air, from which dust was removed by the second filter (124*b*) and which was humidified in the second heat exchanger (62) as described above, flows into the left hand side lower passageway (144) from the second lower left opening (154). Then, this air is distributed through the air supplying side passageway (131) and is supplied through the air supplying opening (117) to the indoor space as humidity controlled air (SA).

On the other hand, room air (RA) being distributed through the right hand side lower passageway (146) enters the lower space of the first heat exchange chamber (41) from the first lower right opening (157). Then, this air flows upwardly and is distributed through the inflow space of the first heat exchanger (61). Moisture present in the air is adsorbed by the adsorbent of the first heat exchanger (61) functioning as an evaporator. The resulting heat of adsorption is absorbed by the refrigerant in the first heat exchanger (61).

The air after passage through the first heat exchanger (61) is distributed in a direction from the lower to the upper side of the first filter (124*a*). At this time, dust particles, trapped at the upper side of the first filter (124*a*) in the aforesaid first operation, are blown away therefrom by air flowing upwardly through the first filter (124*a*). In this way, removal of the dust trapped at the upper side of the first filter (124*a*) is accomplished. Then, the dust is pressure-fed to outside the first heat exchange chamber (41) by air which has passed through the first filter (124*a*).

The air, which gave moisture to the adsorbent of the first heat exchanger (61) and which is containing dust removed from the first filter (124*a*) as described above, flows into the right hand side upper passageway (145) from the first upper right opening (155). Then, this air is distributed through the air exhausting side passageway (132) and is discharged, as exhaust air (EA), to the outdoor space from the air exhausting opening (118).

Advantageous Effects of the Sixth Embodiment

According to the humidity control system (10) of the present embodiment, the outdoor filters (124*a*, 124*b*) are arranged and formed, respectively, along the inflow surface of outside air (OA) in the first heat exchanger (61) and along the inflow surface of outside air (OA) in the second heat exchanger (62). Here, the inflow surface of each of the first and second heat exchangers (61, 62) has a larger area in comparison with the other surfaces. Because of such arrangement, it becomes possible to increase the filter surface area of each of the outdoor filters (124*a*, 124*b*). Accordingly, the linear velocity of outside air (OA) distributed through the outdoor filters (124*a*, 124*b*) can be made slower, thereby making it possible to inhibit the rise in pressure loss due to the installation of the outdoor filters (124*a*, 124*b*). In addition, dust particles contained in the outside air (OA) are less likely to be trapped locally in the outdoor filters (124*a*, 124*b*). This inhibits the outdoor filters (124*a*, 124*b*) from being clogged with dust and further inhibits the rise in pressure loss.

In addition, in the humidity control system (10) of the present embodiment, it is arranged such that dust carried by outside air (OA) and then trapped by the first filter (124*a*) in the first operation is blown away therefrom by room air (RA) in the second operation and is discharged to the outdoor space. On the other hand, dust carried by outside air (OA) and then trapped by the second filter (124*b*) in the second operation is blown away therefrom by room air (RA) in the first operation and is discharged to the outdoor space. In this way, while establishing switching between the first operation and the second operation, dust trapped by the outdoor filter (124*a*) and dust trapped by the outdoor filter (124*b*) are alternately removed, thereby making it possible to automatically eliminate the occurrence of clogging of the outdoor filters (124*a*, 124*b*) with dust and to reduce the frequency of maintenance and replacement of the outdoor filters (124*a*, 124*b*).

Besides, in the humidity control system (10) of the present embodiment, the first pre-filter (123*a*) is provided in addition to the outdoor filters (124*a*, 124*b*). This inhibits the entrance of dust particles of relatively large size present in outside air (OA) into the casing (11). This therefore further inhibits the occurrence of dust adhesion in the first and second heat exchangers (61, 62).

Furthermore, in the humidity control system (10) of the present embodiment, dust particles present in room air (RA) is inhibited, by the provision of the second pre-filter (123*b*), from adhering to the first and second heat exchangers (61, 62). This therefore makes it possible to inhibit the performance of adsorption/desorption from deteriorating due to dust adhesion in the first and second heat exchangers (61, 62).

First Variation of the Sixth Embodiment

Figure 18:
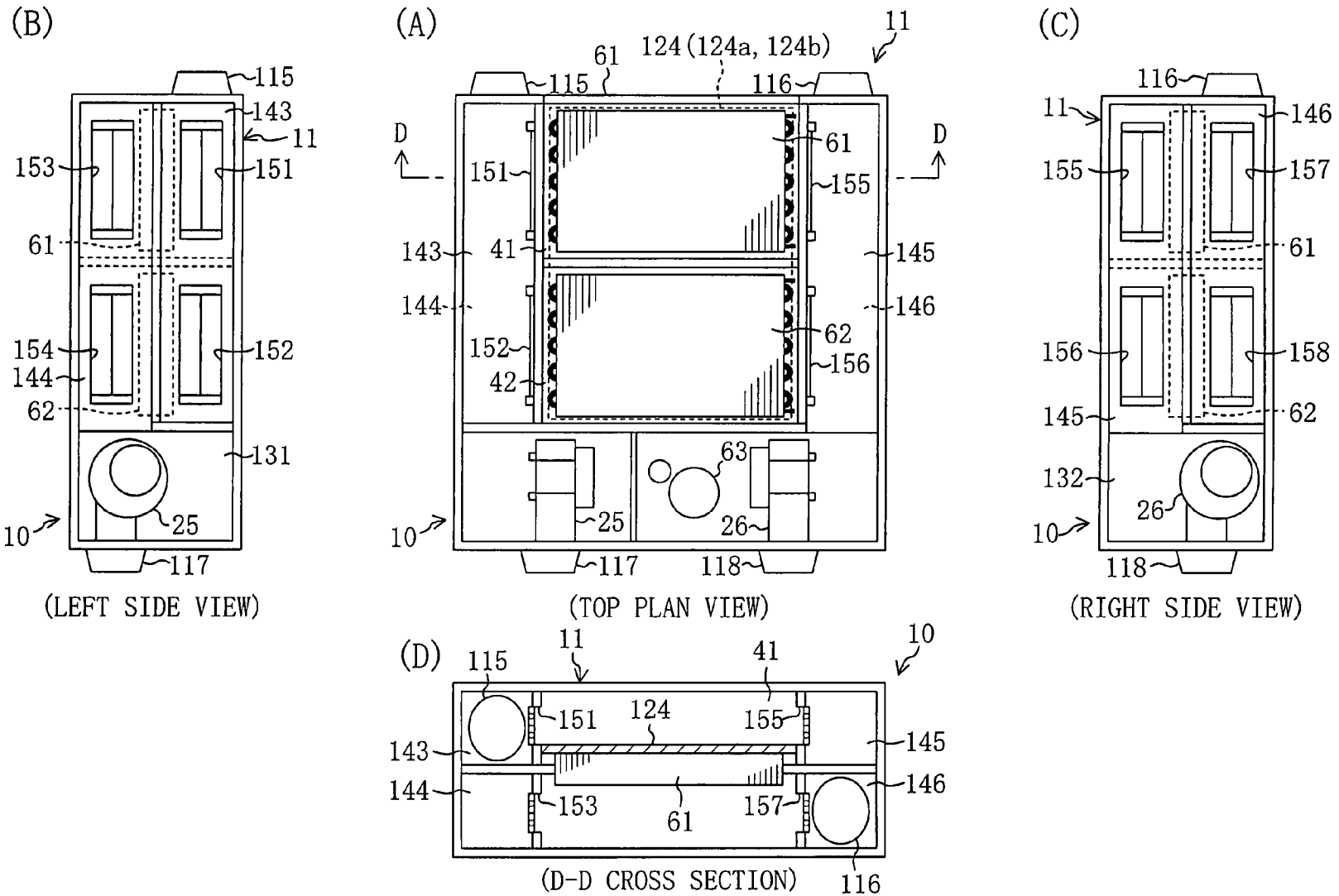
Figure 19:
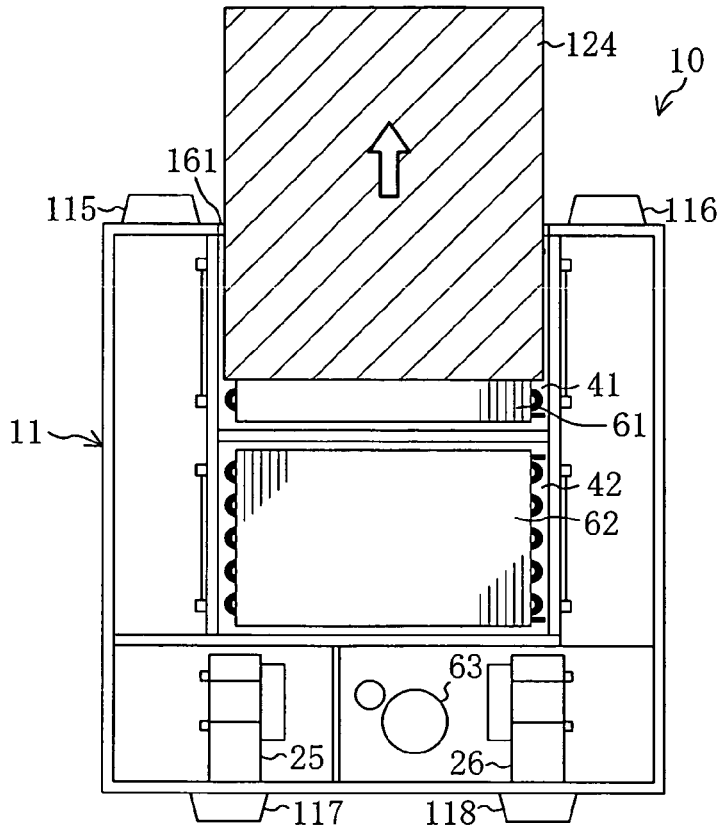
FIG. 19 is a top plan view of the humidity control system of the first variation of the sixth embodiment showing a filter take-out operation in the humidity control system.

With reference to FIGS. 18 and 19, the description will be made with respect to a first variation on the humidity control system (10) of the sixth embodiment. This first variation provides a humidity control system (10) substantially identical in configuration with the humidity control system (10) of the sixth embodiment, with the exception that it includes neither the pre-filter (123) or the first and second inlet passageways (133, 134) in which the pre-filter (123) is disposed. In addition, the first filter (124*a*) disposed in the first heat exchange chamber (41) and the second filter (124*b*) disposed in the second heat exchange chamber (42) integrally constitute the outdoor filter (124).

More specifically, in the humidity control system (10) of the first variation, the first inlet opening (115) and the left hand side upper passageway (143) are brought into direct fluid communication with each other, while the second inlet opening (116) and the right hand side lower passageway (146) are brought into direct fluid communication with each other. In addition, the outdoor filter (124) as a result of integral formation of the first filter (124*a*) and the second filter (124*b*) is arranged and formed on the upper sides of the first and second heat exchangers (61, 62). And the outdoor filter (124) is arranged and formed along and extended over both the inflow surface of outside air (OA) in the first heat exchanger (61) and the inflow surface of outside air (OA) in the second heat exchanger (62). Furthermore, the rear surface panel (110*a*) of the casing (11) is provided with a take-out opening (161) through which the outdoor filter (124) can be taken out.

Also in the humidity control system (10) of the first variation, by arranging and forming the outdoor filter (124) along the inflow surface of each of the heat exchangers (61, 62), it becomes possible to reduce the linear velocity of air flowing into each inflow surface, and the pressure loss of the outside filter (124) can be reduced. In addition, by providing a larger filter surface area against the flow of outside air, it becomes possible to scatter dust particles present in the outside air on the filter surface to trap them. This therefore inhibits the outside filter (124) from being clogged with dust, thereby making it possible to further reduce the pressure loss of the outdoor filter (124).

In addition, in the first variation, the first and second filters (124*a*, 124*b*) are integrally formed with each other, which accomplishes compact formation of the outdoor filter (124). Furthermore, by the arrangement that the casing (11) is provided with the take-out opening (161), the outdoor filter (124) can be easily taken out to outside the casing (11) and can be easily mounted in place in the casing (11), as shown in FIG. 19. Since the outdoor filter (124) is formed integrally, this improves the workability of replacement and maintenance of the outdoor filter (124).

Second Variation of the Sixth Embodiment

Figure 20:
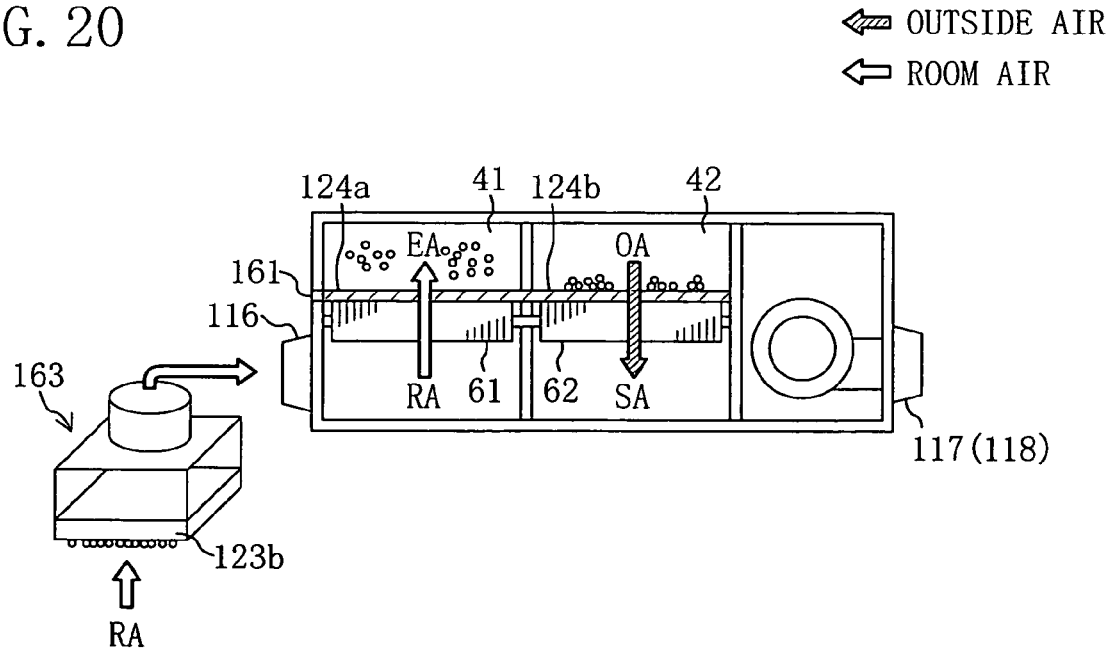
FIG. 20 is a schematic constructional diagram of a humidity control system according to a second variation of the sixth embodiment.

With reference to FIG. 20, the description will be made with respect to a second variation on the humidity control system (10) of the sixth embodiment. The second variation provides a humidity control system (10) having the substantially same configuration as the humidity control system (10) of the sixth embodiment. In the humidity control system (10) of the second variation, the second pre-filter (123*b*) for trapping dust particles present in room air (RA) is arranged in the vicinity of where a suction duct (163) which is so formed as to extend to the indoor space from the casing (11) is opened. The suction duct (163) constitutes a suction opening and is in fluid communication with the right hand side lower passageway (146) via the second inlet opening (116). Accordingly, the suction duct (163) functions as a room air supplying passageway for introducing room air (RA) into the casing (11). Accordingly, because of the provision of the second pre-filter (123*b*) in the suction duct (163), dust particles present in the room air (RA) are trapped by the second pre-filter (123*b*), thereby making it possible to inhibit dust particles present in the room air (RA) from adhering to the lower side of each of the first and second adsorption heat exchangers (3).

In addition, also in the second variation, dust particles present in outside air (OA) are trapped by the first and second filters (124*a*, 124*b*). Thereafter, these trapped dust particles are discharged to the outdoor space by switching between the first operation and the second operation. This therefore reduces the frequency of maintenance of the first and second filters (124*a*, 124*b*).

On the other hand, in the second variation, the second pre-filter (123) uncapable of automatic dust removal is positioned in the vicinity of the opening part of the suction duct (163) which faces the indoor space. This therefore makes it possible to perform maintenance of the second pre-filter (123*b*) from the indoor space side. This therefore facilitates maintenance of the second pre-filter (123*b*), even when the humidity control system (10) is, for example, of the ceiling flush mounting type.

Other Embodiments

Like the third embodiment as shown in FIG. 10, the humidity control system (10) may be of a so-called "cassette" type in which the first inflow path (43) and the first outflow path (44) are provided "upside down" and the second inflow path (45) and the second outflow path (46) are provided "upside down" in the casing (11); in conformity to such "upside down" arrangement, the four openings (51, 52, 53, 54) of the third partition plate (33) and the four openings (55, 56, 57, 58) of the second partition plate (32) are provided "upside down"; and in the bottom plate (81) the supply air outlet opening (24) is formed on the lower side of the air supplying fan (25) and the inside air inlet opening (22) is formed on the lower side of the first inflow path (43).

In the above case, it suffices if the outside air inlet duct (71) is fluidly connected to the outside air inlet opening (21) of the fourth lateral plate (15) in the casing (11) and the exhaust air outlet duct (73) is fluidly connected to the exhaust air outlet opening (23). This eliminates the need for the provision of the ducts (72, 74) in fluid communication with the room, thereby making it possible to make more efficient use of the underroof space.

In addition, in regard to the humidity control systems (10) of the foregoing embodiments, they may be installed not under the roof but on the floor.

In addition, in each of the foregoing embodiments, the first and second heat exchangers (61, 62) are formed by fin and tube heat exchangers of the cross fin type. Other than this type of heat exchanger, for example, corrugated fin heat exchangers, may be used.

INDUSTRIAL APPLICABILITY

As has been described above, the present invention is useful for humidity control systems which perform refrigeration cycles for regeneration and cooling of the adsorbent.

What is claimed is:

1. A humidity control system for supplying either one of a dehumidified first air stream and a humidified second air stream to an indoor space and for discharging the other air stream to an outdoor space, the humidity control system comprising:

a refrigerant circuit which includes a first and a second adsorbent-supported heat exchangers, which are both fluidly connected in the refrigerant circuit to perform a refrigeration cycle, and which is capable of reversing the circulation direction of a refrigerant;

a box-shaped casing having larger horizontal dimensions than its vertical dimension, and internally having an air passageway in which the heat exchangers are disposed side by side in a horizontal plane;

an air supplying fan and an air exhausting fan which are disposed in the casing; and a switching mechanism for changing the distribution route of air in the casing depending on the circulation direction of the refrigerant in the refrigerant circuit so that a first air stream is passed through one of the heat exchangers that is functioning as an evaporator while a second air stream is passed through the other heat exchanger that is functioning as a condenser, wherein the casing has an internal space which is divided into a first space defined along a fan side lateral plate as a lateral plate of the casing, and a remaining second space, the air supplying fan and the air exhausting fan are disposed in the first space and the first and second heat exchangers and the switching mechanism are disposed in the second space, a compressor of the refrigerant circuit is disposed between the air supplying fan and the air exhausting fan in the first space of the casing, the casing is provided with a partition plate for partitioning the first space into an air supplying side space provided with the air supplying fan and the compressor, and an air exhausting side space provided with an air exhausting fan, and an operation in which air having passed through the first heat exchanger flows into the air supplying side space, and air having passed through the second heat exchanger flows into the air exhausting side space, and an operation in which air having passed through the second heat exchanger flows into the air supplying side space, and air having passed through the first heat exchanger flows into the air exhausting side space are alternatively performed.

2. The humidity control system of any one of claim 1, wherein, in the casing, an outlet opening and an inlet opening are opened to provide a fluid connection with ducts in fluid communication with the indoor space and another outlet opening and another inlet opening are opened to provide a fluid connection with ducts in fluid communication with the outdoor space.

3. The humidity control system of any one of claim 1, wherein, in the casing, an outlet opening and an inlet opening are opened to provide a direct fluid communication between the casing and the indoor space and another outlet opening and another inlet opening are opened to provide a fluid connection with ducts in fluid communication with the outdoor space.

4. The humidity control system of claim 1, wherein the casing is shaped like a flattened box with a thickness direction defined parallel to shortest side of the flattened box, and the first and second heat exchangers are so arranged as to allow passage of air in the thickness direction of the casing.

5. The humidity control system of claim 1, wherein the casing is shaped like a flattened box with a thickness direction defined parallel to shortest side of the flattened box, and the first and second heat exchangers are so arranged as to allow passage of air in a direction perpendicular to the thickness direction of the casing.

6. The humidity control system of claim 1, wherein the casing is shaped like a flattened box with a thickness direction defined parallel to shortest side of the flattened box, and the air supplying fan and the air exhausting fan each comprises a respective multi-blade fan which is configured to draw in air from a lateral side of a fan casing thereof and then deliver it forward and which is disposed such that the center of an axle of its impeller is oriented in the thickness direction of the casing.

7. The humidity control system of claim 6, wherein:

an air supplying opening and an inside air inlet opening which are in fluid communication with the indoor space are provided in one of two lateral plates of the casing which are orthogonal to the fan side lateral plate, and an air exhausting opening and an outside air inlet opening which are in fluid communication with the outdoor space are provided in the other of the lateral plates;

in the second space, (i) a first heat exchange chamber in which the first heat exchanger is accommodated and a second heat exchange chamber in which the second heat exchanger is accommodated are defined adjacently side by side in a direction orthogonal to the fan side lateral plate, (ii) a first inflow path for the inflow of air and a first outflow path for the outflow of air are provided which extend along a continuous lateral surface of one of the two heat exchange chambers, respectively, and which are superimposedly arranged in the thickness direction of the casing, and (iii) a second inflow path for the inflow of air and a second outflow path for the outflow of air are provided which extend along a continuous lateral surface of the other of the two heat exchange chambers and which are superimposedly arranged in the thickness direction of the casing; and the outflow paths are in fluid communication with the first space through fan side communication openings.

8. The humidity control system of claim 6, wherein:

an air supplying opening in fluid communication with the indoor space and an air exhausting opening in fluid communication with the outdoor space are provided in the fan side lateral plate of the casing and an inside air inlet opening and an outside air inlet opening are provided in a lateral plate opposite the fan side lateral plate;

in the second space, (i) a first heat exchange chamber in which the first heat exchanger is accommodated and a second heat exchange chamber in which the second heat exchanger is accommodated are defined adjacently side by side in the longitudinal direction of the fan side lateral plate and (ii) between one of continuous lateral surfaces of the two heat exchange chambers and the lateral plate opposite the fan side lateral plate a first inflow path for the inflow of air and a second inflow path for the inflow of air are provided which extend along the lateral plate and which are superimposedly arranged in the thickness direction of the casing and between the other of the continuous lateral surfaces of the two heat exchange chambers and the fan side lateral plate a first outflow path for the outflow of air and a second outflow path for the outflow of air are provided which extend along the fan side lateral plate and which are superimposedly arranged in the thickness direction of the casing; and the outflow paths are in fluid communication with the first space through fan side communication openings.

9. The humidity control system of either claim 7 or 8, wherein:

the air supplying fan is arranged such that a fan inlet opening, provided in the lateral side of the fan casing of the air supplying fan, faces either one of the fan side communication openings; and the air exhausting fan is arranged such that a fan inlet opening, provided in the lateral side of the fan casing of the air exhausting fan, faces the other of the fan side communication openings.

10. The humidity control system of claim 1, wherein the humidity control system includes an outdoor filter which is arranged and formed along both an outside-air inflow surface of the first heat exchanger and an outside-air inflow surface of the second heat exchanger.

11. The humidity control system of either claim 1 or 10, wherein:

a first passageway in which the first heat exchanger is disposed, a second passageway in which the second heat exchanger is disposed, and a room-air supplying passageway through which room air is made to flow into either of the first or the second passageways are formed in the casing; and the humidity control system includes an indoor filter which is disposed in the room-air supplying passageway.

12. The humidity control system of either claim 1 or 10, wherein:

a first passageway in which the first heat exchanger is disposed and a second passageway in which the second heat exchanger is disposed are formed in the casing; and the humidity control system includes:

a suction opening which faces the indoor space by being in fluid connection with an air passageway which is located nearer to the indoor space than the first and second passageways in the casing; and an indoor filter which is disposed in the vicinity of an opening part of the suction opening.

13. The humidity control system of claim 10, wherein:

a first passageway in which the first heat exchanger is disposed and a second passageway in which the second heat exchanger is disposed are formed in the casing; and the outdoor filter includes a first filter part disposed in the first passageway, and a second filter part disposed in the second passageway.

14. The humidity control system of claim 10, wherein the casing is provided with a take-out opening from which the outdoor filter can be taken out.

15. The humidity control system of claim 13, wherein:

in the outdoor filter, the first filter part and the second filter part are integral with each other; and the outdoor filter is arranged such that it extends over both the outside-air inflow surface of the first heat exchanger and the outside-air inflow surface of the second heat exchanger.

16. The humidity control system of claim 13, wherein the humidity control system is operable to switch its operation between:

a first operation in which outside air is distributed first through the first filter part and then through the first heat exchanger and is thereafter supplied to the indoor space while simultaneously room air is distributed first through the second heat exchanger and then through the second filter part and is thereafter discharged to the outside space; and a second operation in which outside air is distributed first through the second filter part and then through the second heat exchanger and is thereafter supplied to the indoor space while simultaneously room air is distributed first through the first heat exchanger and then through the first filter part and is thereafter discharged to the outdoor space.

17. The humidity control system of claim 13, wherein:

the humidity control system includes an indoor filter which is disposed in a passageway through which room air is made to flow into either of the first or the second passageways; and the humidity control system is operable to switch its operation between:

a first operation in which outside air is distributed first through the first filter part and then through the first heat exchanger and is thereafter supplied to the indoor space while simultaneously room air is distributed first through the indoor filter, then through the second heat exchanger, and then through the second filter part and is thereafter discharged to the outside space; and a second operation in which outside air is distributed first through the second filter part and then through the second heat exchanger and is thereafter supplied to the indoor space while simultaneously room air is distributed first through the indoor filter, then through the first heat exchanger, and then through the first filter part and is thereafter discharged to the outdoor space.

18. The humidity control system of claim 15, wherein, within the casing, the first heat exchanger and the second heat exchanger are disposed adjacently to each other and the inflow surface of the first heat exchanger and the inflow surface of the second heat exchanger lie on the same plane, said same plane being perpendicular to the fan side lateral plate.

* * * * *